US010369782B2

(12) United States Patent
Momose et al.

(10) Patent No.: US 10,369,782 B2
(45) Date of Patent: Aug. 6, 2019

(54) ADJUSTMENT METHOD OF RECORDING HEAD AND RECORDING APPARATUS

(71) Applicant: SEIKO EPSON CORPORATION, Tokyo (JP)

(72) Inventors: Manabu Momose, Jakarta (ID); Masaki Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/987,456

(22) Filed: May 23, 2018

(65) Prior Publication Data

US 2018/0339509 A1 Nov. 29, 2018

(30) Foreign Application Priority Data

May 29, 2017 (JP) ..... 2017-105376

(51) Int. Cl.
*B41J 2/045* (2006.01)
*B41J 2/21* (2006.01)
*B41J 19/14* (2006.01)

(52) U.S. Cl.
CPC ..... *B41J 2/04508* (2013.01); *B41J 2/04586* (2013.01); *B41J 2/2135* (2013.01); *B41J 19/145* (2013.01); *B41J 2/2132* (2013.01)

(58) Field of Classification Search
CPC ..... B41J 2/04508; B41J 2/04586; B41J 2/04516; B41J 2/04526; B41J 2/04573; B41J 2/125; B41J 2/2132; B41J 2/2135
See application file for complete search history.

(56) References Cited

U.S. PATENT DOCUMENTS 5,576,744 A * 11/1996 Niikura ..... B41J 2/04505 347/14
9,296,231 B2 * 3/2016 Teraji ..... B41J 19/207

FOREIGN PATENT DOCUMENTS

JP 2001-341293 A 12/2001
JP 4276356 B 3/2009

* cited by examiner

*Primary Examiner* — Thinh H Nguyen
(74) *Attorney, Agent, or Firm* — Workman Nydegger

(57) ABSTRACT

There is provided an adjustment method of a recording head which adjusts a landing position of an ink droplet in a printer including the print head, in which a plurality of nozzles are arranged and which performs printing by using the ink droplet to be ejected while relatively moving in a scanning direction (relative movement direction) with respect to a roll paper. The adjustment method of the recording head includes reading a pattern image by dots formed by the ejected ink droplets and calculating a tendency of a spatial positional relationship between each nozzle and a dot corresponding to each nozzle based on the read pattern image, and in which the landing position of the liquid droplet ejected from each nozzle 131 is adjusted based on the tendency calculated in the calculating the tendency of the spatial positional relationship.

12 Claims, 17 Drawing Sheets

ADJUSTMENT METHOD OF RECORDING HEAD AND RECORDING APPARATUS

BACKGROUND

1. Technical Field

The present invention relates to a recording apparatus that performs recording by applying liquid droplets to a recording medium, and an adjustment method of a recording head provided in the recording apparatus.

2. Related Art

As a method of adjusting the recording head of the recording apparatus that performs recording by applying liquid droplets, for example, in JP-A-2001-341293, a method of adjusting a position of a recording head based on a recording result of a predetermined test pattern in a recording apparatus provided with reading means for reading a test pattern recorded by the recording head is described.

However, according to the adjustment method described in JP-A-2001-341293, since adjustment of deviation in the XY plane of the recording head is performed based on information on the deviation in the XY plane of the predetermined test pattern, there is a problem that deviation of a recording position in the XY plane due to an inclination in the Z direction with respect to the XY plane of the recording head cannot be adjusted in some cases.

SUMMARY

The invention can be realized in the following aspects or application examples.

Application Example 1

According to this application example, there is provided an adjustment method of a recording head which adjusts a landing position of a liquid droplet in a recording apparatus including the recording head, in which a plurality of nozzles are arranged and which performs recording by using the liquid droplet to be ejected while relatively moving in a relative movement direction with respect to a recording medium, includes reading a pattern image by dots formed by the ejected liquid droplets and calculating a tendency of a spatial positional relationship between each of the nozzles and a dot corresponding to each of the nozzles based on the read pattern image, and in which the landing position of the liquid droplet ejected from each of the nozzles is adjusted based on the tendency calculated in the calculating the tendency of the spatial positional relationship.

According to this application example, the adjustment method which adjusts the landing position of the liquid droplet includes the image read step of reading the pattern image by dots formed by ejected liquid droplets, and the tendency calculation step of calculating the tendency of the spatial positional relationship between each nozzle and the dot corresponding to each nozzle based on the pattern image read in the image read step. Since the landing position of the liquid droplet ejected from each nozzle is adjusted based on the tendency of the spatial positional relationship between each nozzle and the dot corresponding to each nozzle, it is possible to more accurately perform adjustment of the landing position of the liquid droplet not only regarding deviation of an attachment position of the recording head in a plane parallel to a recording surface of the recording medium but also regarding deviation of the attachment position of the recording head in a direction intersecting with the recording surface of the recording medium. As a result, it is possible to more accurately suppress, for example, deterioration in recording quality due to an inclination of the recording head with respect to the recording surface of the recording medium.

Application Example 2

In the adjustment method of the recording head according to the application example, the tendency may be calculated based on an inclination of an approximate straight line, which is obtained from the pattern image formed in a direction intersecting with the relative movement direction, with respect to the relative movement direction.

Since there are variation in characteristics (characteristics such as ejection amount, ejection direction, ejection speed, deviation in ejection timing) that a plurality of nozzles arranged in the recording head eject liquid droplets, variations may occur in positions and sizes of dots formed on the recording medium. According to this application example, the tendency of the spatial positional relationship between each nozzle and the dot corresponding to each nozzle may be calculated based on the inclination of the approximate straight line, which is obtained from the pattern image formed in the direction intersecting with the relative movement direction, with respect to the relative movement direction. Since the approximate straight line allows variation in the positions and sizes of dots formed on the recording medium to contribute to calculation of the tendency as a statistically more reliable representative value, it is possible to more accurately obtain a tendency of the distance between each nozzle and the recording surface (that is, a tendency of spatial positional relationship between each nozzle and the dot corresponding to each nozzle). As a result, it is possible to more accurately suppress, for example, deterioration in recording quality due to an inclination of the recording head with respect to the recording surface of the recording medium.

Application Example 3

In the adjustment method of the recording head according to the application example, the center of gravity of the pattern image of the dot corresponding to each nozzle may be detected and the approximate straight line may be obtained based on a plurality of the centers of gravity.

According to this application example, the center of gravity of the pattern image formed by the dots corresponding to each nozzle is detected and the approximate straight line is obtained based on a plurality of the centers of gravity. For that reason, even when there is variation in each dot constituting the pattern image corresponding to each nozzle varies, the tendency can be more accurately calculated. As a result, it is possible to more accurately suppress, for example, deterioration in recording quality due to an inclination of the recording head with respect to the recording surface of the recording medium.

Application Example 4

In the adjustment method of the recording head according to the application example, the tendency is calculated based on the pattern image formed in a forward path relatively reciprocating in the relative movement direction with respect to the recording medium and the pattern image formed in a backward path relatively reciprocating in the relative movement direction with respect to the recording medium.

In a case where the recording head is inclined with respect to the recording surface of the recording medium, the distance between the nozzle and the recording surface becomes unequal in a plurality of nozzles arranged in the recording head and thus, a difference is generated between the pattern image formed in the forward path relatively reciprocating in the relative movement direction with respect to the recording medium and the pattern image formed in the backward path relatively reciprocating in the relative movement direction with respect to the recording medium. According to the application example, since the tendency is calculated based on the pattern image formed in the forward path relatively reciprocating in the relative movement direction with respect to the recording medium and the pattern image formed on the backward path relatively reciprocating in the relative movement direction with respect to the recording medium, it is possible to more accurately obtain the tendency (that is, tendency of the spatial positional relationship between each nozzle and the dot corresponding to each nozzle) of the distance between each nozzle and the recording surface. As a result, it is possible to more accurately suppress, for example, deterioration in recording quality due to an inclination of the recording head with respect to the recording surface of the recording medium.

Application Example 5

In the adjustment method of the recording head according to the application example, a parallelity adjustment step of adjusting the degree of parallelity between a nozzle row constituted with the plurality of nozzles aligned in a direction intersecting with the relative movement direction and the recording medium facing the nozzle row based on the tendency is included.

According to this application example, since the parallelity adjustment step of adjusting the degree of parallelity between the nozzle row and the recording medium facing the nozzle row based on the calculated tendency is included, in a case where the nozzle row is not disposed parallel to the recording medium facing the nozzle row, it is possible to more accurately perform adjustment.

Application Example 6

In the adjustment method of the recording head according to the application example, a skew adjustment step of adjusting the degree of intersection angle between the relative movement direction and the direction in which the nozzle row extends based on the tendency is included.

According to this application example, since the skew adjustment step of adjusting the degree of the intersection angle of the nozzle row with respect to the relative movement direction based on the calculated tendency is included, in a case where the nozzle row is disposed to deviate from a predetermined intersection angle with respect to the relative movement direction, it is possible to more accurately perform the adjustment.

Application Example 7

In the adjustment method of the recording head according to the application example, the skew adjustment step is performed after the parallelity adjustment step.

According to this application example, the skew adjustment step is performed after the parallelity adjustment step. The parallelity adjustment step is performed first so as to make it possible to suppress the difference between the pattern image formed in the forward path and the pattern image formed in the backward path in the relative movement direction. As a result, adjustment in the skew adjustment step for adjusting the degree of the intersection angle of the nozzle row with respect to the relative movement direction can be more easily conducted.

Application Example 8

In the adjustment method of the recording head according to the application example, a timing adjustment step of adjusting a timing of ejecting the liquid droplet from the nozzle based on the tendency is included.

According to this application example, the timing adjustment step of adjusting the timing of ejecting the liquid droplet from the nozzle based on the calculated tendency is included. For that reason, for example, it is possible to correct deviation of the landing position of the liquid droplet in the relative movement direction caused due to the inclination of the recording head in the relative movement direction without correcting the inclination of the recording head.

Application Example 9

According to this application example, there is provided a recording apparatus including a recording head which includes a plurality of nozzles for ejecting liquid droplets onto a recording medium are arranged, a moving unit which relatively moves the recording head in a relative movement direction with respect to the recording medium, an image reading unit which reads a pattern image by dots formed by the ejected liquid droplets, and a control unit which calculates a tendency of a spatial positional relationship between each nozzle and a dot corresponding to each nozzle based on the pattern image read by the image reading unit.

According to this application example, the recording apparatus includes the image reading unit which reads the pattern image by dots formed by the ejected liquid droplets and the control unit which calculates the tendency of the spatial positional relationship between each nozzle and the dot corresponding to each nozzle based on the pattern image read by the image reading unit. That is, according to the recording apparatus of the application example it is possible to ascertain not only the tendency of deviation of the attachment position of the recording head in the plane parallel to the recording surface of the recording medium but also the tendency of deviation of the attachment position of the recording head in the direction intersecting with the recording surface of the recording medium. As a result, for example, it is possible to perform adjustment for suppressing deterioration in the recording quality due to the inclination of the recording head with respect to the recording surface of the recording medium.

Application Example 10

In the recording apparatus according to the application example, an adjustment unit which adjusts an attachment posture of the recording head based on the calculated tendency is included.

According to this application example, the recording apparatus includes the adjustment unit adjusting the attachment posture of the recording head based on the calculated tendency. That is, in the recording apparatus, it is possible to adjust the attachment posture of the recording head based on the tendency, which is calculated based on the pattern image read by the image reading unit, of the spatial positional relationship between each nozzle and the dot corresponding to each nozzle. As a result, for example, in a case where the recording head is inclined with respect to the recording surface of the recording medium, it is possible to more accurately suppress deterioration in recording quality due to the inclination.

Application Example 11

In the recording apparatus according to the application example, a plurality of nozzle rows each of which is constituted with a plurality of the nozzles aligned in a direction intersecting with the relative movement direction are arranged and the pattern image for calculating the tendency is formed by the nozzles constituting a reference nozzle row among the plurality of nozzle rows.

According to this application example, the plurality of nozzle rows each of which is constituted with the plurality of the nozzles aligned in the direction intersecting with the relative movement direction are arranged and the pattern image for calculating the tendency is formed by the nozzles constituting the reference nozzle row among the plurality of nozzle rows. That is, the pattern image for calculating the tendency of the spatial positional relationship between the nozzle and the dot corresponding to the nozzle is formed by the nozzles included in the reference nozzle row among the plurality of nozzle rows arranged in the recording head. For example, it is possible to obtain a pattern image in which the attachment posture (degree of parallelity and degree of skewing) of the image is more reflected by forming a pattern image by using the nozzle rows arranged in both end areas of the recording head in the relative movement direction and nozzle rows including nozzles disposed in corner area of the recording head as the reference nozzle rows. As a result, it is possible to more accurately obtain information, which reflects the tendency of the spatial positional relationship between each nozzle and the dot corresponding to each nozzle, of the posture of the recording head.

Application Example 12

In the recording apparatus according to the application example, the nozzle rows constituted with the plurality of nozzles aligned in the direction intersecting with the relative movement direction are arranged for each color of the liquid droplets to be ejected and the pattern image is formed by the liquid droplets having a plurality of colors.

According to this application example, the nozzle rows constituted with the plurality of nozzles aligned in the direction intersecting with the relative movement direction are arranged for each color of the liquid droplets to be ejected and the pattern image is formed by the liquid droplets having a plurality of colors. Since the pattern image is formed by liquid droplets of the plurality of colors, that is, the pattern image is formed by the plurality of nozzles included in the plurality of nozzle rows, the tendency can be obtained as a tendency of the plurality of nozzles included in the plurality of nozzle rows (for example, as a tendency over the entire recording head). At this time, for example, in a case where a pattern is formed by landing inks of different colors on the same position of the pattern image from the plurality of nozzle rows, the pattern image becomes a pattern having lower lightness, for example, like a composite black color and thus, when a pattern image is formed on a white recording medium, contrast of the color becomes high and it becomes easier to recognize the tendency.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
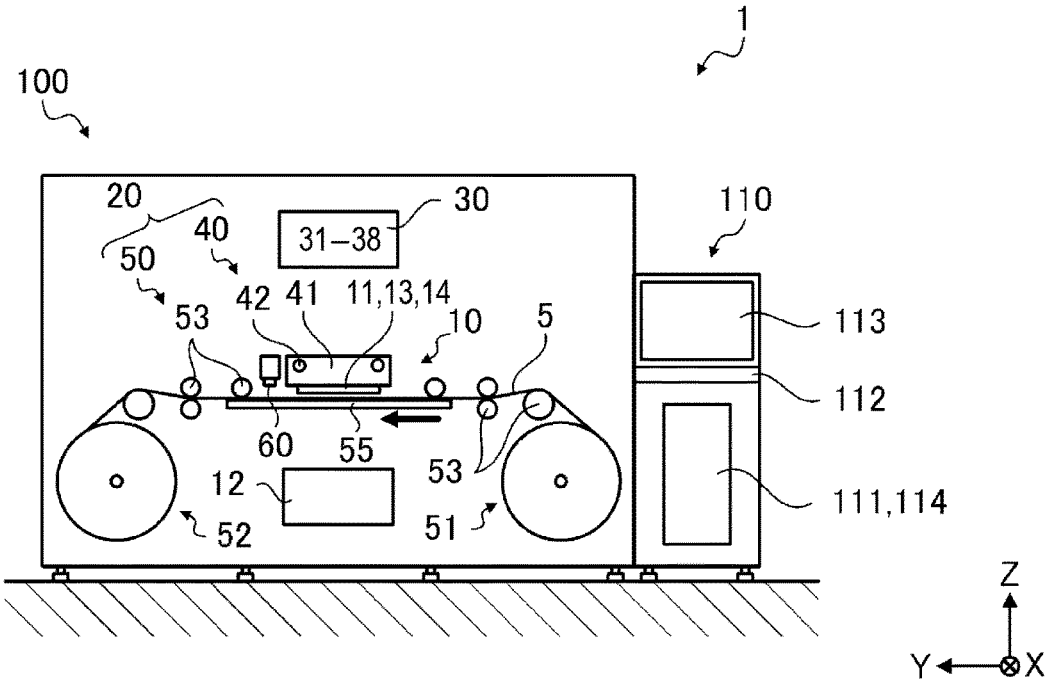
FIG. 1 is a front view illustrating a configuration of a recording apparatus (printer) according to Embodiment 1.

Hereinafter, embodiments embodying the invention will be described with reference to the drawings. Hereinafter, embodiment embodying the invention will be described with reference to the drawings by taking "printing" which is one form of "recording" as an example. That is, the following is one embodiment of the invention and is not intended to limit the invention. In the following respective drawings, in order to make explanation easier to understand, description may be made in a scale different from an actual scale. In addition, in the coordinates attached to the drawing, the Z-axis direction is the up-and-down direction, the +Z direction is the up direction, the X-axis direction is the front-and-rear direction, the −X direction is the front direction, the Y-axis direction is the left-and-right direction, the +Y direction is the left direction, and the X-Y plane is a horizontal plane.

Embodiment 1

Figure 2:
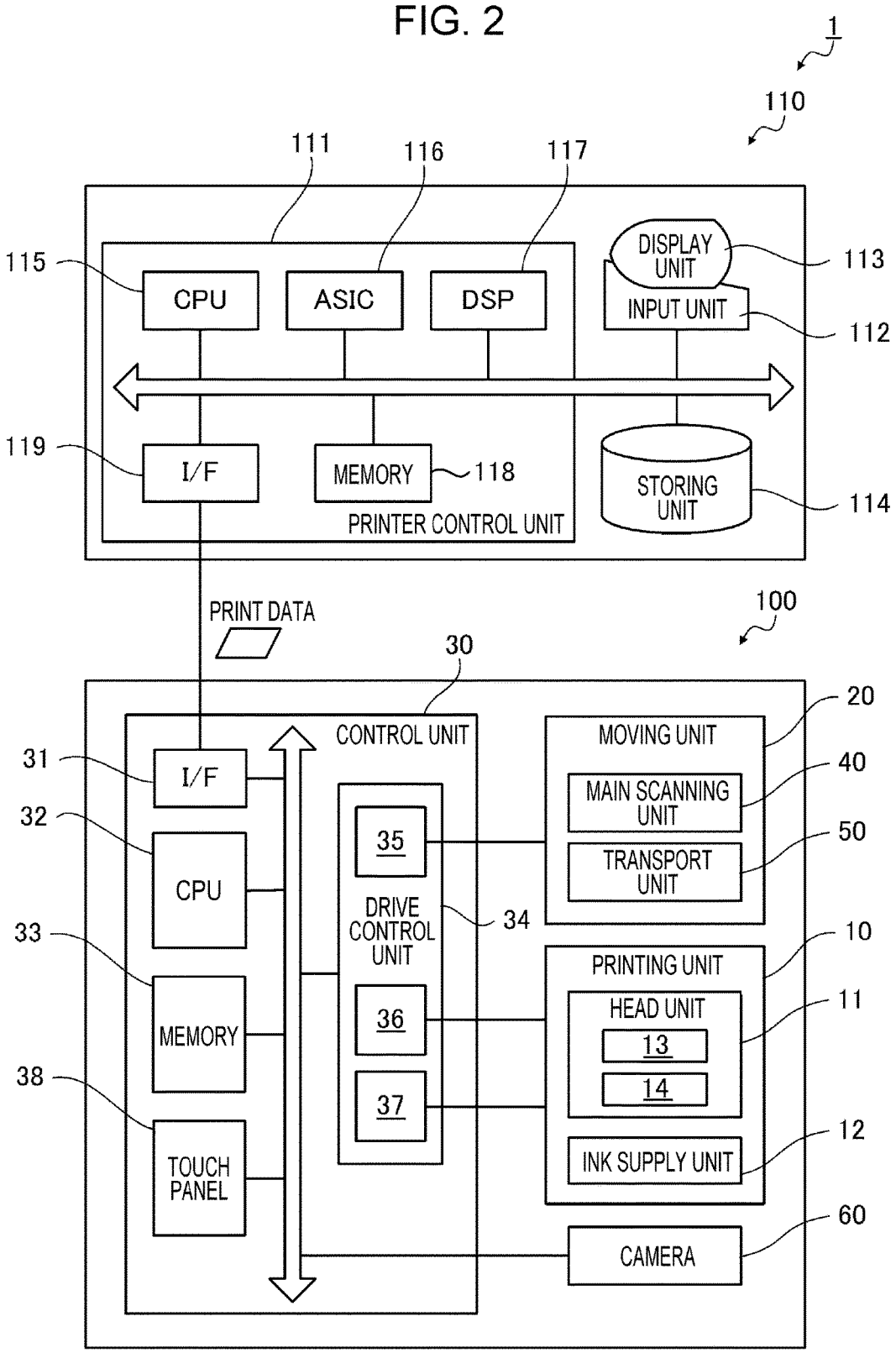
FIG. 2 is a block diagram illustrating a configuration of the recording apparatus (printer) according to Embodiment 1.

FIG. 1 is a front view illustrating a configuration of a printer 100 according to Embodiment 1, and FIG. 2 is a block diagram of the printer 100.

The printer 100 constitutes a printing system 1 with a control device 110 connected to the printer 100.

The printer 100 is an ink jet printer that prints a desired image on a long roll paper 5 supplied in a state of being wound in a roll shape, based on print data received from the control device 110.

The printer 100 is a "recording device" in the invention and the roll paper 5 is a "recording medium" in the invention.

Basic Configuration of Control Device

The control device 110 includes a printer control unit 111, an input unit 112, a display unit 113, a storing unit 114, and the like, and controls a print job that causes the printer 100 to perform printing. The control device 110 is configured using a personal computer as a preferred example.

Software allows the control device 110 to operate includes general image processing application software (hereinafter, referred to as application) that handles image data to be printed and printer driver software (hereinafter, referred to as printer driver) that performs control of the printer 100 and generates print data for causing the printer 100 to execute printing.

That is, the control device 110 controls the printer 100 via print data for causing the printer 100 to print a print image based on image data.

The printer driver is not limited to an example configured as a functional unit by software, and may be configured with, for example, firmware. The firmware is installed in, for example, the System on Chip (SOC), in the control device 110.

The printer control unit 111 includes a CPU 115, an ASIC 116, a DSP 117, a memory 118, a printer interface unit (I/F) 119, and the like, and centrally manages the entire printing system 1.

The input unit 112 is an information input unit as a human interface. Specifically, for example, the input unit 112 is a port to which a keyboard or an information input device is connected.

The display unit 113 is an information display unit (display) as the human interface and displays information input from the input unit 112, images to be printed on the printer 100, and information relating to a print job, and the like under the control of the printer control unit 111.

The storing unit 114 is a rewritable storage medium such as a hard disk drive (HDD) or a memory card and stores software (program operated by the printer control unit 111) which allows the control device 110 to operate, image to be printed, information relating to the print job.

The memory 118 is a storage medium for securing an area storing a program which allows the CPU 115 to operate, a working area in which the program is operated, and the like, and is configured with a memory element such as a RAM, an EEPROM, and the like.

Basic Configuration of Printer 100

The printer 100 is configured with a printing unit 10, a moving unit 20, a control unit 30, and the like. When print data is received from the control device 110, the printer 100 controls a printing unit 10 and the moving unit 20 by the control unit 30 and prints an image (forms image) on the roll paper 5.

The print data is data for forming image obtained by converting image data so that the image data can be printed by the printer 100 using the application and the printer driver included in the control device 110, and includes a command for controlling the printer 100.

The image data includes, for example, general full-color image information, text information obtained by a digital camera, and the like.

The printing unit 10 is constituted with a head unit 11, an ink supply unit 12, and the like.

The moving unit 20 is constituted with a scanning unit 40, a transport unit 50, and the like. The scanning unit 40 is constituted with a carriage 41, a guide shaft 42, a carriage motor (not illustrated), and the like. The transport unit 50 is constituted with a supply portion 51, a storage portion 52, a transport roller 53, a platen 55, and the like.

The head unit 11 includes a print head 13 having a plurality of nozzles (nozzle groups) for ejecting printing ink (hereinafter, referred to as ink) as ink droplets, and a head control unit 14. The head unit 11 is attached on the carriage 41 and reciprocates in the scanning direction along with the carriage 41 moving in the scanning direction (X-axis direction in FIG. 1). The head unit 11 (print head 13) ejects ink droplets onto the roll paper 5 supported by the platen 55 under the control of the control unit 30 while moving in the scanning direction, such that dot rows (raster line) along the scanning direction are formed on the roll paper 5.

The ink droplet is the "liquid droplet" in the invention and the print head 13 is the "recording head" in the invention. Further, the scanning direction is the "relative movement direction" in the invention.

The ink supply unit 12 includes an ink tank and an ink supply path (not illustrated) for supplying ink from the ink tank to the print head 13 and the like. An ink supply passage spanning to the ink tank, the ink supply path, and the nozzles that eject the same ink are independently provided for each ink.

For example, in ink, as a color ink set composed of a dark ink composition, there is an ink set of four colors obtained by adding black (K) to an ink set of three colors of cyan (C), magenta (M), and yellow (Y), and the like. For example, there is a color ink set of eight colors obtained by adding an ink set of light cyan (Lc), light magenta (Lm), light yellow (Ly), light black (Lk), and the like which are made from a light ink composition in which concentration of each color material is lightened, and the like to the ink set of four colors.

A piezo method is used for a method (ink jet method) of ejecting ink droplets. In the piezo method, printing is performed in such a way that pressure corresponding to a print information signal is applied to ink stored in a pressure chamber by a piezoelectric element (piezo element) and ink droplets are injected (ejected) from a nozzle communicating with the pressure chamber.

The method of ejecting ink droplets is not limited thereto, and other printing methods of injecting ink in droplet form to form a group of dots on a print medium may be adopted. For example, a method in which ink is continuously injected from a nozzle in a droplet form with a strong electric field between the nozzle and an accelerating electrode placed in front of the nozzle and a printing information signal is given from a deflecting electrode while the ink droplet flies, a method (electrostatic suction method) in which an ink droplet is injected by being associated with the print information signal without deflecting the ink droplet, a method of forcibly injecting ink droplets by applying pressure to ink with a small pump and mechanically vibrating the nozzle with a crystal oscillator or the like, a method (thermal jet method) in which printing in performed in such a way that ink is heated and foamed by a microelectrode according to the print information signal and ink droplets are injected, and the like may be adopted.

The moving unit 20 (scanning unit 40 and transport unit 50) relatively moves the head unit 11 (print head 13) with respect to the roll paper 5 under the control of the control unit 30. Alternatively, the roll paper 5 is relatively moved with respect to the head unit 11 (print head 13). In Embodiment 1, the scanning unit 40 is the "moving unit" in the invention.

The guide shaft 42 extends in the scanning direction and supports the carriage 41 in a slidable contact state, and the carriage motor serves as a driving source when reciprocating the carriage 41 along the guide shaft 42. That is, the scanning unit 40 (carriage 41, guide shaft 42, and carriage motor) moves the carriage 41 (that is, print head 13) along the guide shaft 42 in the scanning direction under the control of the control unit 30.

The supply portion 51 rotatably supports the reel on which the roll paper 5 is wound in a roll form and sends out the roll paper 5 to a transport path. The storage portion 52 rotatably supports the reel for winding up the roll paper 5 and winds up the roll paper 5 from the transport path.

The transport roller 53 is configured with a driving roller for moving the roll paper 5 in the transport direction (Y-axis direction illustrated in FIG. 1) intersecting with the scanning direction, a driven roller rotating accompanied by movement of the roll paper 5, and the like, and configures a transport path for transporting the roll paper 5 from the supply portion 51 to the storage portion 52 via a printing area (area where the print head 13 moves in the scanning direction on the upper surface of the platen 55) of the printing unit 10.

The control unit 30 includes an interface unit (I/F) 31, a CPU 32, a memory 33, a drive control unit 34, a touch panel 38, and the like, and controls the printer 100.

The interface unit 31 is connected to a printer interface unit 119 of the control device 110, and performs data transmission and reception between the control device 110 and the printer 100. The control device 110 and the printer 100 may be connected directly with a cable or indirectly via a network or the like. Data may be transmitted and received between the control device 110 and the printer 100 via wireless communication.

The CPU 32 is an operation processing device for controlling the entire printer 100.

The memory 33 is a storage medium for securing an area for storing a program operated by the CPU 32, a working area in which the program is operated, and the like, and is configured with memory elements such as a RAM and an EEPROM.

The CPU 32 controls the printing unit 10 and the moving unit 20 via the drive control unit 34 according to the program stored in the memory 33 and print data received from the control device 110.

The drive control unit 34 controls driving of the printing unit 10 (head unit 11 and ink supply unit 12) and the moving unit 20 (scanning unit 40 and transport unit 50) under the control of the CPU 32. The drive control unit 34 includes a movement control signal generation circuit 35, an ejection control signal generation circuit 36, and a drive signal generation circuit 37.

The movement control signal generation circuit 35 is a circuit that generates signals for controlling the moving unit 20 (scanning unit 40 and transport unit 50) according to an instruction from the CPU 32.

The ejection control signal generation circuit 36 is a circuit that generates a head control signal for selecting a nozzle to eject ink, for selecting an ejecting amount, controlling the ejection timing, and the like according to an instruction from the CPU 32 based on print data.

The drive signal generation circuit 37 is a circuit that generates a basic drive signal including a drive signal for driving the piezoelectric element of the print head 13.

The drive control unit 34 selectively drives the piezoelectric element corresponding to each of the nozzles based on the head control signal and the basic drive signal.

The touch panel 38 is an information input/output unit as a human interface capable of inputting operation instruction information to the printer 100 (control unit 30) or displaying various information processing results of the control unit 30 (CPU 32).

With the configuration as described above, the control unit 30 forms (prints) a desired image on the roll papers by repeating a pass operation (ejection) of ejecting (applying) ink droplets from the print head 13 while moving the carriage 41 supporting the print head 13 along the guide shaft 42 in the main scanning direction (X-axis direction), with respect to the roll paper 5 supplied to the printing area by the transport unit 50 (supply portion 51 and transport roller 53) and a transport operation for moving the roll paper 5 in the transport direction (Y-axis direction) intersecting with the scanning direction by the transport unit 50 (transport roller 53).

Basic Function of Printer Driver

Figure 3:
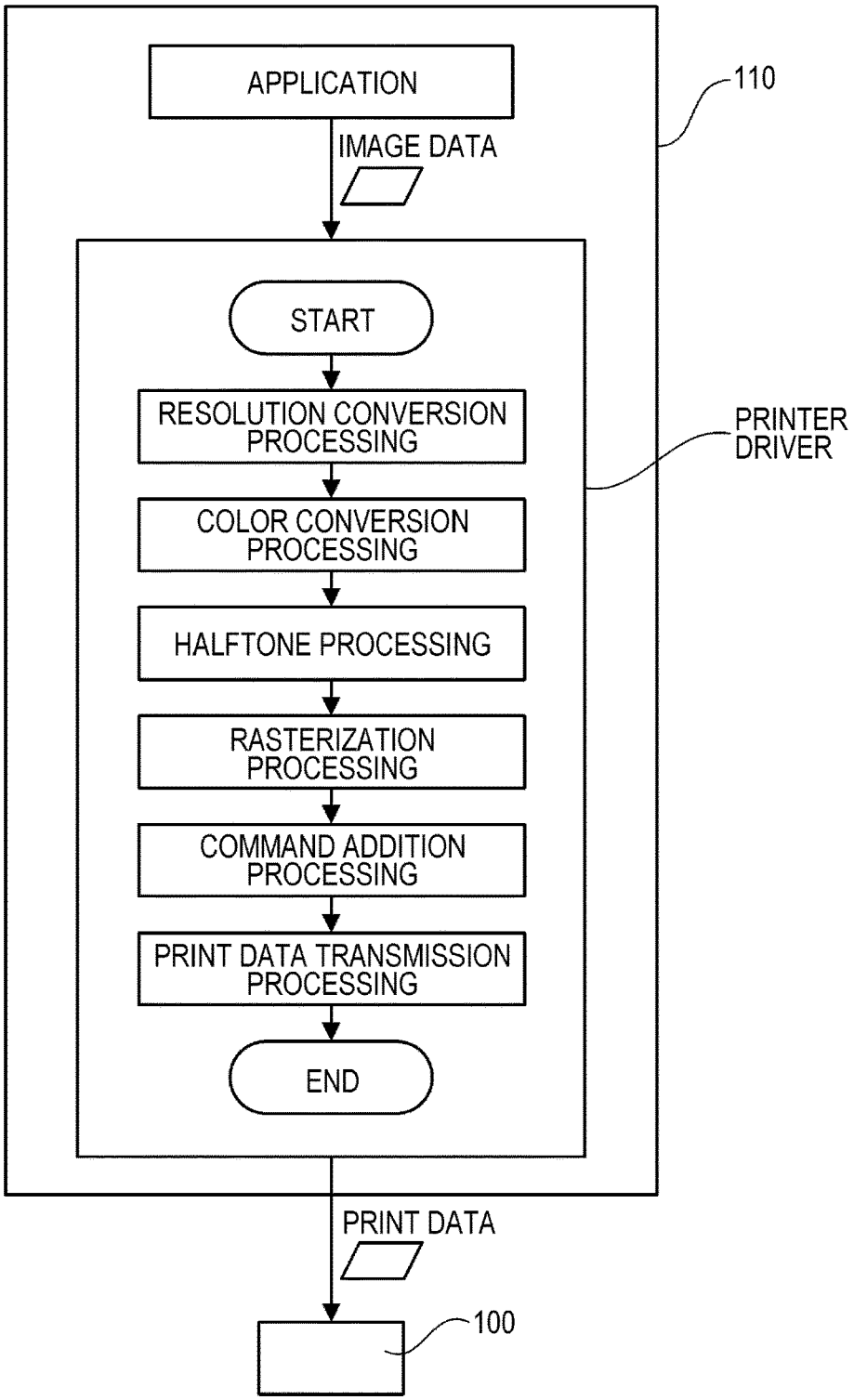
FIG. 3 is an explanatory diagram of basic functions of a printer driver.

FIG. 3 is an explanatory diagram of basic functions of the printer driver.

Printing on the roll paper 5 is started by transmission of print data from the control device 110 to the printer 100. The print data is generated by the printer driver.

Hereinafter, print data generation processing will be described with reference to FIG. 3.

The printer driver receives image data from an application, converts the image data into print data in a format interpretable by the printer 100, and outputs the print data to the printer 100. When image data from the application is converted into the print data, the printer driver performs resolution conversion processing, color conversion processing, halftone processing, rasterization processing, command addition processing, and the like.

Resolution conversion processing is processing for converting resolution of image data output from the application into resolution (print resolution) at the time of printing on the roll paper 5. For example, when print resolution is specified as 720×720 dpi, image data in a vector format received from the application is converted into image data in a bitmap format having resolution of 720×720 dpi. Each pixel data of the image data after resolution conversion processing is configured with pixels arranged in a matrix shape. Each pixel has, for example, a gradation value of 256 gradations in RGB color space. That is, pixel data after the resolution conversion indicates the gradation value of a corresponding pixel.

Pixel data corresponding to one column of pixels aligned in a predetermined direction among pixels arranged in a matrix shape is called raster data. The predetermined direction in which the pixels corresponding to the raster data are aligned corresponds to a movement direction (scanning direction) of the print head 13 at the time of printing the image.

Color conversion processing is processing for converting RGB data into data in CMYK color space. The CMYK colors are cyan (C), magenta (M), yellow (Y), and black (K), and image data in CMYK color space is data corresponding to colors of ink of the printer 100. Accordingly, for example, in a case where the printer 100 uses ten kinds of inks of a CMYK color system, the printer driver generates image data of 10-dimensional space of the CMYK color system based on RGB data.

This color conversion processing is performed based on a table (color conversion look-up table (LUT)) in which gradation values of RGB data are associated with the gradation values of CMYK color system data. Pixel data after color conversion processing is CMYK color system data of, for example, 256 gradations represented by the CMYK color system space.

Halftone processing is processing for converting data of a high gradation number (256 gradations) into data of the number of gradations that can be formed by the printer 100. By this halftone processing, data indicating 256 gradations is converted into, for example, halftone data for determining a dot formation state, such as 1-bit data indicating 2 gradations (dot is present or absent), 2-bit data indicating 4 gradations (no dot, small dot, medium dot, large dot). Specifically, a generation rate of dot corresponding to the gradation value (for example, in the case of four gradations, no dot, small dot, medium dot, and large dot) is obtained from a dot generation rate table in which a gradation value (0 to 255) corresponding to a dot generation rate and pixel data is created so that dots are formed in a dispersed manner by using a dither method, an error diffusion method, or the like, at the obtained generation rate. As described above, in halftone processing, halftone data for determining the formation state of dots formed by a nozzle group ejecting ink of the same color (or the same kind) is generated.

Rasterization processing is processing for sorting pixel data (for example, 1 bit or 2 bit halftone data as described above) aligned in a matrix shape according to dot formation order at the time of printing. Rasterization processing includes allocation processing for allocating image data, which is configured with pixel data (halftone data) after halftone processing, to each pass operation in which the print head 13 (nozzle row) ejects ink droplets while performing scanning movement. When allocation processing is completed, pixel data aligned in a matrix shape is allocated to the actual nozzles which form each raster line forming the print image in each pass operation.

Command addition processing is processing for adding command data according to the printing method to data subjected to rasterization processing. Command data includes, for example, transport data relating to transport specification (speed, amount of movement, and the like in the transport direction (Y-axis direction)) of the print medium (roll paper 5).

These processing by the printer driver are performed by the ASIC 116 and the DSP 117 (see FIG. 2) under the control of the CPU 115, and generated print data is transmitted to the printer 100 via the printer interface unit 119 by print data transmission processing.

Print Head

Figure 4:
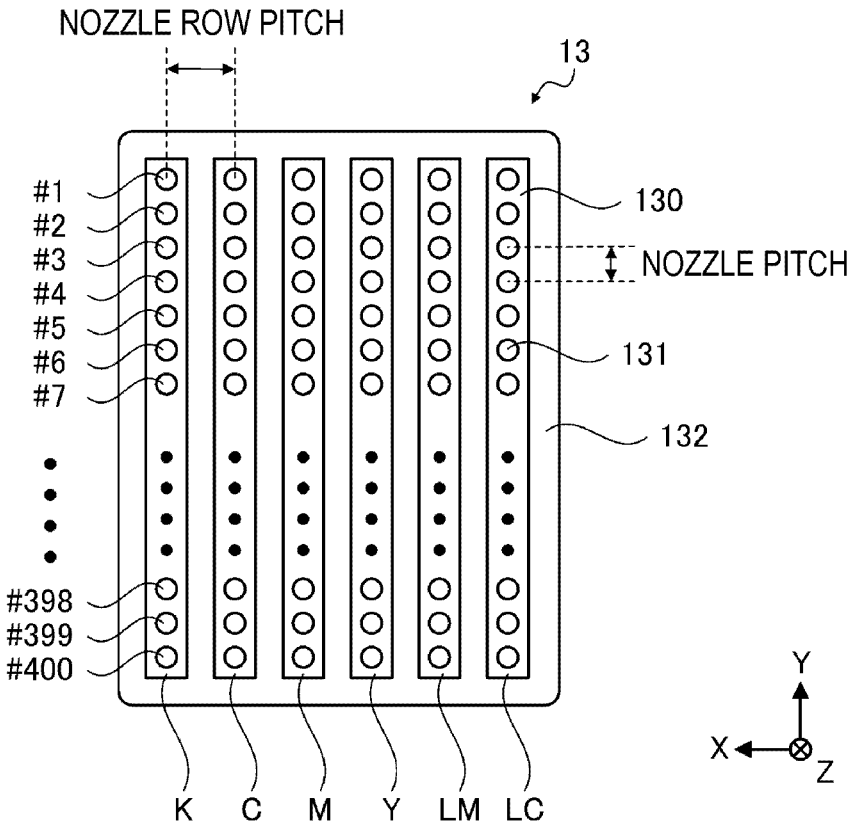
FIG. 4 is a schematic diagram illustrating an example of an arrangement of nozzles in a recording head (print head).

FIG. 4 is a schematic diagram illustrating an arrangement of nozzles in the print head 13. FIG. 4 illustrates a state seen from the lower surface (surface in the nozzle plate 132 side where the nozzle 131 is formed, see FIG. 5) of the print head 13. As illustrated in FIG. 4, the print head 13 includes six nozzle rows 130 (black ink nozzle row K, cyan ink nozzle row C, magenta ink nozzle row M, yellow ink nozzle row Y, light magenta ink nozzle row LM, and light cyan ink nozzle row LC) in which a plurality of nozzles 131 (400 nozzles of #1 to #400 in the example illustrated in FIG. 4) for ejecting each ink are formed side by side in the transport direction (Y-axis direction) at a predetermined nozzle pitch. The nozzle rows 130 are aligned in line to be parallel along a direction (X-axis direction) intersecting with the transport direction (Y-axis direction) at a constant interval (nozzle row pitch).

Each nozzle 131 is provided with a driving element (piezoelectric element such as the piezoelectric element described above) for driving each nozzle 131 to eject an ink droplet.

Variation in Ink Droplet Landing Position

In the printer 100 having the basic configuration described above, in addition to variation in ink ejection characteristics (characteristics such as ejection amount, ejection direction, ejection speed, ejection timing, and the like) of each nozzle 131, there is a case where the ink droplet landing position deviates from a predetermined position and printing quality is deteriorated, due to variation in the attachment posture of the head 13. Variation in the attachment posture of the print head 13 are caused by, for example, variation in attachment accuracy of the print head 13 with respect to the carriage 41, variation in support accuracy for supporting each of the guide shaft 42 and the platen 55, and the like.

Figure 5:
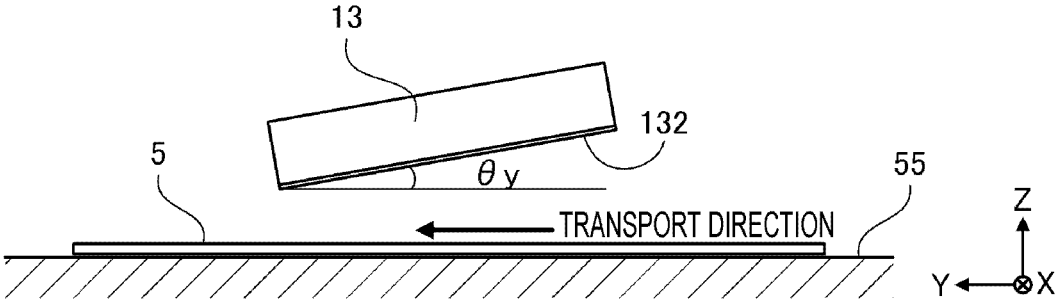
FIG. 5 is a conceptual diagram for explaining variation in an attachment posture of the recording head (print head).
Figure 6:
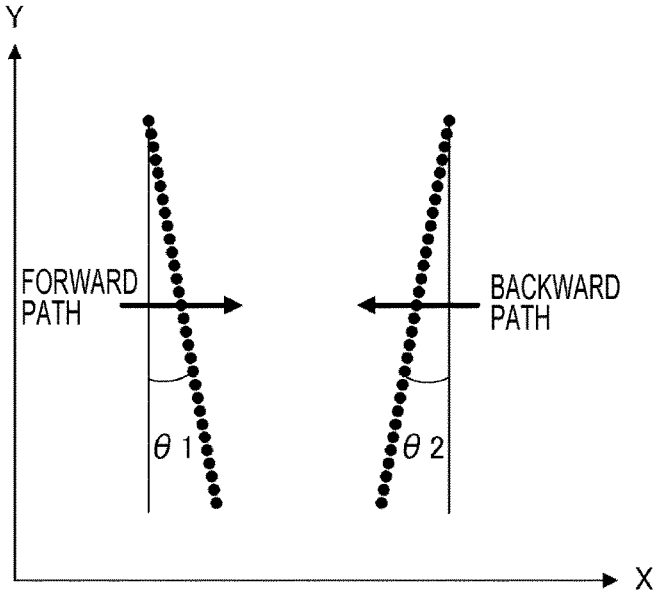
FIG. 6 is a conceptual diagram for explaining deviation of a dot position (ink droplet landing position).
Figure 7:
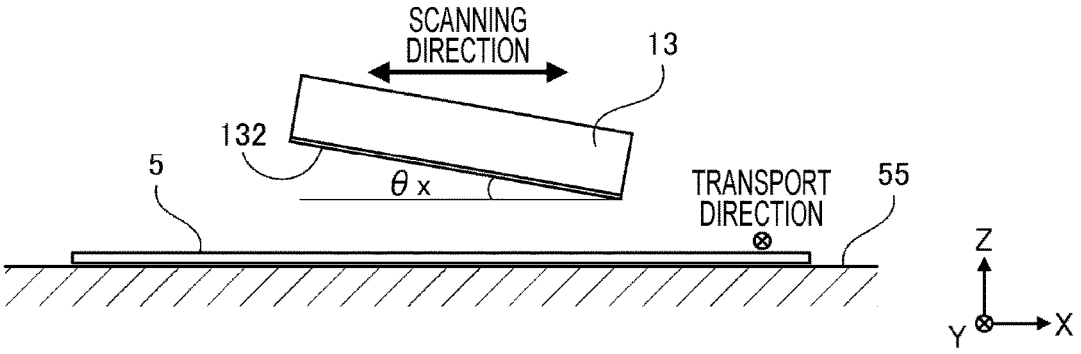
FIG. 7 is a conceptual diagram for explaining a variation in the attachment posture of the recording head (print head).
Figure 8:
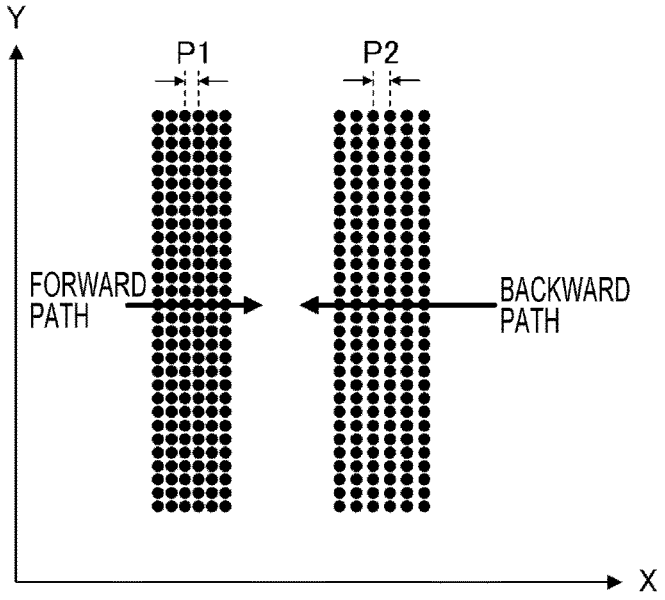
FIG. 8 is a conceptual diagram for explaining deviation of the dot position (ink droplet landing position).
Figure 9:
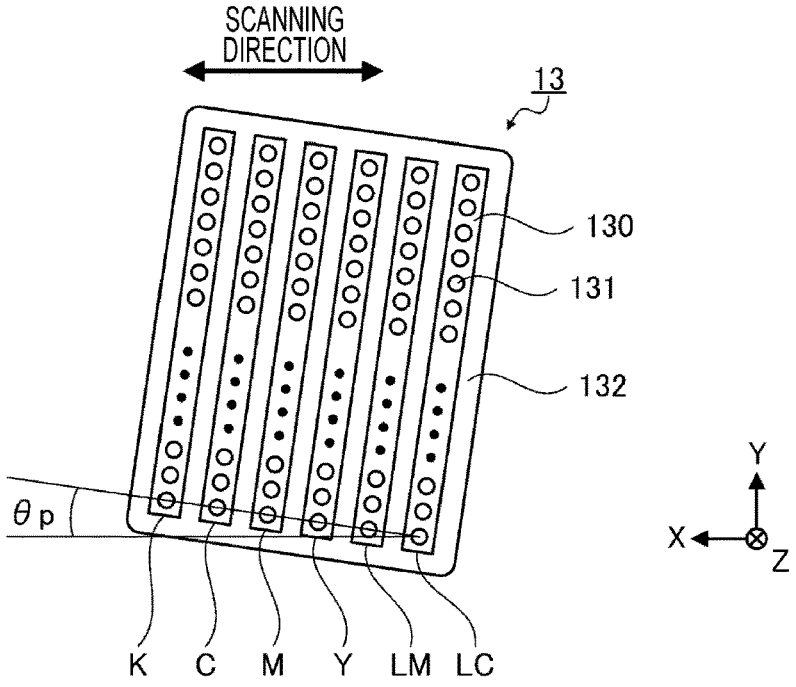
FIG. 9 is a conceptual diagram for explaining variation in the attachment posture of the recording head (print head).
Figure 10:
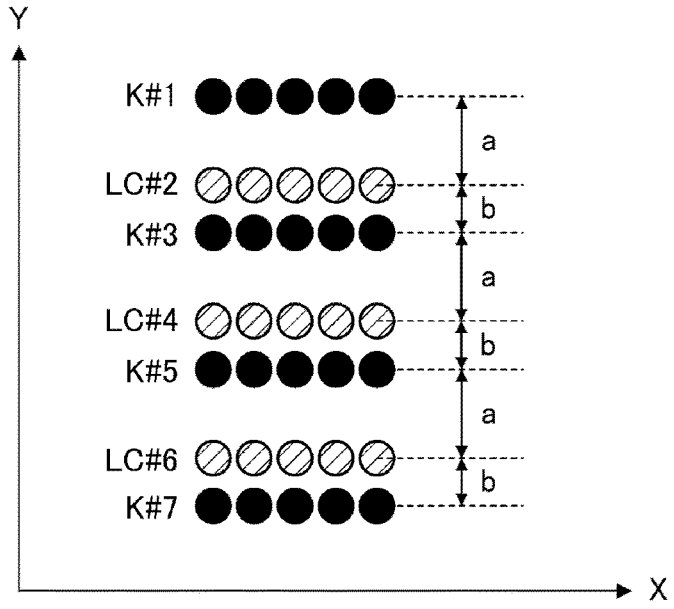
FIG. 10 is a conceptual diagram for explaining deviation of the dot position (ink droplet landing position).

FIGS. 5, 7, and 9 are conceptual diagrams for explaining variation in attachment posture of the print head 13. FIGS. 6, 8, and 10 are conceptual diagrams for explaining deviation of dot positions (ink droplet landing positions) when there is deviation in attachment posture of the print head 13.

FIG. 5 illustrates an example in the case where the print head 13 (nozzle plate 132) is attached in an inclined posture with respect to the platen 55 (that is, the surface of the roll paper 5 supported by the platen 55).

In this example, the print head 13 (nozzle plate 132) is attached by being inclined at an angle θy so that the print head 13 (nozzle plate 132) approaches the platen 55 (that is, the surface of the roll paper 5) as the print head 13 goes in the transport direction (+Y direction). That is, the print head is attached in such a way that the direction in which the nozzle row 130 extends (see FIG. 4) is deviated from the direction (Y-axis direction) parallel to the surface of the platen 55 that supports the roll paper 5 facing the nozzle row 130 and the distance between the tip end portion of the nozzle 131 included in the same nozzle row 130 and the platen 55 (surface of the roll paper 5) becomes shorter as the nozzle 131 positioned on the +Y side (to bow to the +Y side) becomes shorter.

FIG. 6 is a conceptual diagram for explaining deviation of a position (ink droplet landing position) of dots that occurs in a case where the print head 13 is attached as illustrated in FIG. 5.

In the example illustrated in FIG. 6, dot rows formed by ejecting ink droplets one shot at a time at the same timing from each nozzle 131 of one nozzle row 130 in the forward and backward directions in the scanning direction (X-axis direction) are illustrated. For the sake of clarity, 30 dots are illustrated at positions that do not overlap in the forward path and the backward path.

The closer the ink droplets ejected from the nozzles 131 are to the platen 55 (surface of the roll paper 5), the earlier timing the ink droplets ejected from the nozzles 131 land on the surface of the roll paper 5 and thus, the formed dot rows, as illustrated in FIG. 6, have different inclinations in the forward path and the backward path with respect to the Y-axis direction.

In the case where there is no variation in ejection characteristics of the nozzles 131, the scanning movement speed at the timing of ejection is equal, and there is no inclination in the X-axis direction of the print head 13 (nozzle plate 132), as illustrated in FIG. 6, the inclination of the formed dot rows are reversed between the forward path and the backward path, and the inclination angles θ1 and θ2 become equal.

The example illustrated in FIG. 7 is another example in which the print head 13 (nozzle plate 132) is inclined with respect to the platen 55 (surface of the roll paper 5).

In this example, the print head 13 (nozzle plate 132) is attached by being inclined at an angle θx so that the print head 13 approaches the platen 55 (surface of the roll paper 5) as the print head 13 goes in the forward scanning direction (+X direction). That is, the print head 13 is attached in such a way that the distance between the nozzle row 130 of each color arranged in parallel and the platen 55 (surface of the roll paper 5) becomes shorter as the nozzle row 130 positioned on the +X side becomes shorter.

FIG. 8 is a conceptual diagram for explaining deviation of the position (ink droplet landing position) of dots generated in a case where the print head 13 is attached as illustrated in FIG. 7.

In the example illustrated in FIG. 8, dot rows formed by ejecting ink droplets by one shot at a time at the same timing from the respective nozzles 131 of the six nozzle rows 130 in the forward and backward directions in the scanning direction (X-axis direction) are illustrated. For the sake of clarity, it is indicated by 30 dots per nozzle row 130 at positions that do not overlap each other in the forward path and backward path.

The closer the ink droplets ejected from the nozzles 131 are to the platen 55 (surface of the roll paper 5), the earlier timing the ink droplets ejected from the nozzle row 130 land and thus, spacing of the formed dot rows in the X-axis direction is, as illustrated in FIG. 8, the forward path and the backward path are different, and a pitch P2 in the backward path is larger than a pitch P1 in the forward path. As shown in FIG. 8, spacing of the formed dot rows in the X-axis direction is different between the forward path and the return path, and the pitch P2 in the backward path is larger than the pitch P1 in the forward path.

In the example illustrated in FIG. 9, an example in a case where the print head 13 (nozzle plate 132) is rotated and attached within a plane (XY plane) parallel to the platen 55 (surface of the roll paper 5) is illustrated.

In this example, when seen from the lower surface (surface on the side of the nozzle plate 132) of the print head 13, the print head 13 is attached by being rotated by an angle θp clockwise. That is, the print head 13 performs scanning movement (that is, skews) in the X-axis direction while being rotated by an angle θp clockwise.

When the print head 13 (nozzle plate 132) has an inclination within a plane (XY plane) parallel to the platen 55 (surface of the roll paper 5), the dot rows formed by ejecting one shot of ink droplets simultaneously from the nozzles 131 of one nozzle row 130 also have an inclination in the same direction. The deviation occurs in the ink droplet landing positions in the Y-axis direction between the different nozzle rows 130.

FIG. 10 is a conceptual diagram for explaining deviation of the position (ink droplet landing position) of dots generated in a case where the print head 13 is attached as illustrated in FIG. 9.

In the example illustrated in FIG. 10, the deviation in the Y-axis direction between dots formed by the black ink nozzle row K and the light cyan ink nozzle row LC positioned at both ends in the X-axis direction of the print head 13 is illustrated. In the black ink nozzle row K, ink droplets are ejected continuously from the odd numbered nozzles 131 to form dot rows aligned in the X-axis direction, and in the light cyan ink nozzle row LC, ink droplets are ejected continuously from the even numbered nozzles 131 to form dot rows aligned in the X-axis direction. In a case where there is no inclination in the XY plane (attachment in a rotated state) of the print head 13, spacing between the dot row by the odd numbered nozzles 131 (black ink nozzle row K) and the dot row by the even row nozzle 131 (light cyan ink nozzle row LC) are equal to each other, but in a case where the print head 13 has an inclination in the X-Y plane, the spacing is not uniform. As illustrated in FIG. 9, in a case where the print head 13 is rotated and attached, the black ink nozzle row K is deviated in the +Y direction and the light cyan ink nozzle row LC is deviated in the −Y direction and thus, as illustrated in FIG. 10, the spacing between the dot rows satisfies a relationship of pitch a>pitch b. Since FIG. 10 is a conceptual diagram, dots deviated in the Y direction are illustrated to be emphasized, but in a case where ink droplets are ejected at the same timing from the plurality of nozzles 131, the formed dots are also deviated in the X direction.

Adjustment of Print Head Attachment Position (Adjustment of Ink Droplet Landing Position)

Variation (deviation) in the attachment posture of the print head 13 includes not only the examples described above, but also respective attachment deviations in reverse directions, or may be composite deviation of inclination and rotation. However, as described above, since there is a correlation between the deviation of the attachment posture of the print head 13 and the degree of deviation from the predetermined posture and the tendency of the pattern of the formed dots, this correlation is quantified so as to make it possible to ascertain and adjust the degree of deviation of the attachment posture of the print head 13 from the predetermined posture. Specifically, a predetermined pattern image based on this correlation is printed and a printed predetermined pattern image is analyzed so as to make it possible to ascertain the amount of deviation of the attachment posture of the print head 13 from the predetermined posture.

In addition to the basic configurations described above, the recording apparatus (printer 100) of Embodiment 1 further includes a camera 60 as an "image reading unit" for reading the pattern image by dots formed by ejected ink droplets, and has a function of calculating the tendency of the spatial positional relationship between each nozzle 131 and the dot corresponding to each nozzle 131 based on the pattern image read by the camera 60, as the function of the control unit 30. It is possible to adjust the attachment posture of the print head 13 based on the tendency (tendency of the spatial positional relationship between each nozzle 131 and the dot corresponding to each nozzle 131) calculated based on the printed pattern image.

That is, in the adjustment method of the ink droplet landing position in Embodiment 1, the step (image read step) of reading the pattern image by dots formed by ejected ink droplets and the step (tendency calculation step) of calculating the tendency of the spatial positional relationship between each nozzle 131 and the dot corresponding to each nozzle 131.

The landing position of the ink droplet ejected from each nozzle 131 is adjusted based on the tendency calculated in the tendency calculation step.

Adjustment of the ink droplet landing position can also be performed by adjustment of the timing of ejecting the ink droplet, in addition to adjustment of the attachment posture of the print head 13.

Adjustment of the attachment posture of the print head 13 includes a parallelity adjustment step, a skew adjustment step, and the like.

In the following, description will be made in detail.

The camera 60 is a digital still camera having an imaging element (area sensor) using, for example, a charge coupled device (CCD) or complementary metal oxide semiconductor (CMOS) as an optical element. As illustrated in FIG. 1, the camera 60 can capture (that is, reads the pattern image by dots formed by the ejected ink droplets) an image of the surface of the roll paper 5 which is provided at downstream of the printing area in the transport direction of the roll paper 5 and on which printing has been completed. The camera 60 transmits the captured pattern image to the control unit 30.

The control unit 30 analyzes the received pattern image by image processing and calculates the tendency of the spatial positional relationship between each nozzle 131 and the dot corresponding to each nozzle 131 based on the pattern image.

The "image reading unit" is not limited to the camera 60, but may be a scanner or the like having a line sensor for scanning the surface of the roll paper 5 after printing.

Parallelity Adjustment (Bow Adjustment)

First, parallelity adjustment for adjusting the inclination (bow to the +Y side) of the print head 13 (nozzle plate 132) as illustrated in FIG. 5 will be described. The parallelity adjustment step is a parallelity adjustment step of adjusting the degree of parallelity between the nozzle row 130 constituted with the plurality of nozzles 131 aligned in the direction (Y-axis direction) intersecting with the scanning direction (X-axis direction) and the roll paper 5 facing the nozzle row 130.

Figure 11:
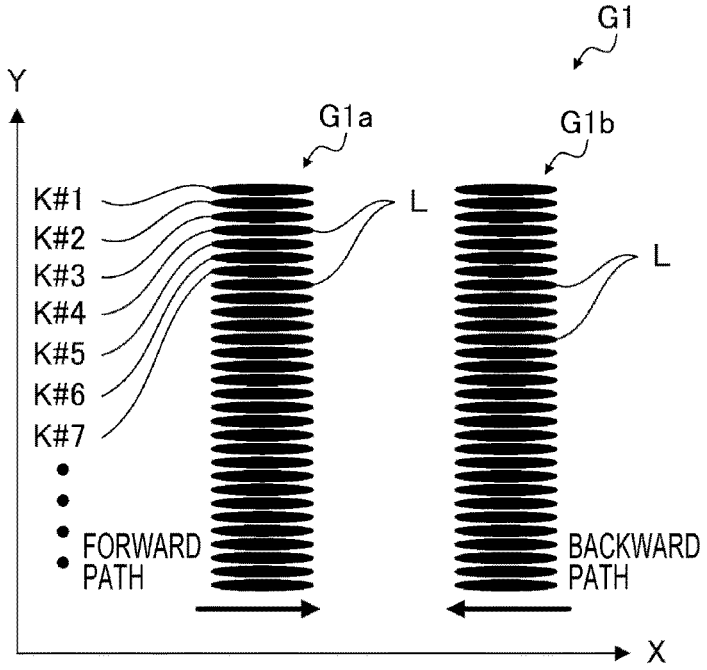
FIG. 11 is a conceptual diagram illustrating a pattern image used in a parallelity adjustment step.

FIG. 11 is a conceptual diagram illustrating a pattern image G1 used in the parallelity adjustment step.

The pattern image G1 is composed of a pattern image G1*a* and a pattern image G1*b* and is formed by ink droplets ejected from all the nozzles 131 of the black ink nozzle row K having a high contrast with respect to the white roll paper 5, for example.

The pattern image G1*a* is a pattern to be rendered in the forward path for scanning movement, and is constituted with a plurality of line segments L to be formed by continuously ejecting ink droplets a predetermined number of times from all the nozzles 131 (K#1 to K#400) at the same time while performing scanning movement in the +X direction.

The pattern image G1*b* is a pattern to be rendered in the backward path of the scanning movement, and is constituted with a plurality of line segments L to be formed by continuously ejecting a predetermined number of times from all the nozzles 131 (K#1 to K#400) at the same time while performing scanning movement in the −X direction.

Figure 12:
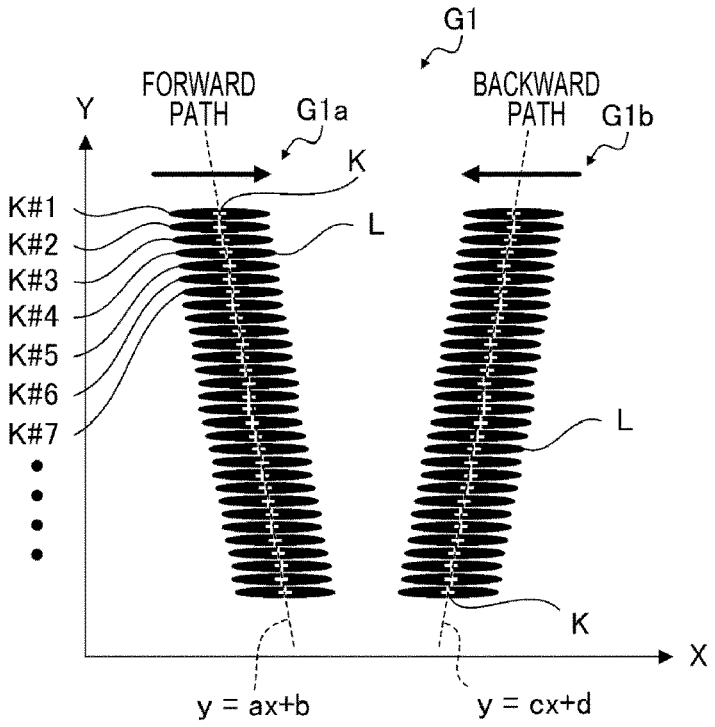
FIG. 12 is a conceptual diagram illustrating a pattern image printed when there is an inclination of the print head.

FIG. 12 is a conceptual diagram illustrating a pattern image G1 to be printed when there is an inclination (bow to +Y side) of the print head 13 (nozzle plate 132) as illustrated in FIG. 5.

Matters that the pattern image G1*a* and the pattern image G1*b* have different inclinations in the forward and backward directions with respect to the Y-axis direction are the same as those contents described with reference to FIG. 6.

The camera 60 acquires the pattern image G1 (image read step) and transmits the pattern image G1 to the control unit 30. The control unit 30 obtains the inclination of each of the pattern images G1*a* and G1*b* from the received pattern image G1 so as to calculate the degree of inclination of the print head 13 (nozzle plate 132) as the tendency of the spatial positional relationship between each nozzle 131 and the dot corresponding to each nozzle 131. Also, a necessary adjustment value is calculated based on the calculated tendency.

Figure 13:
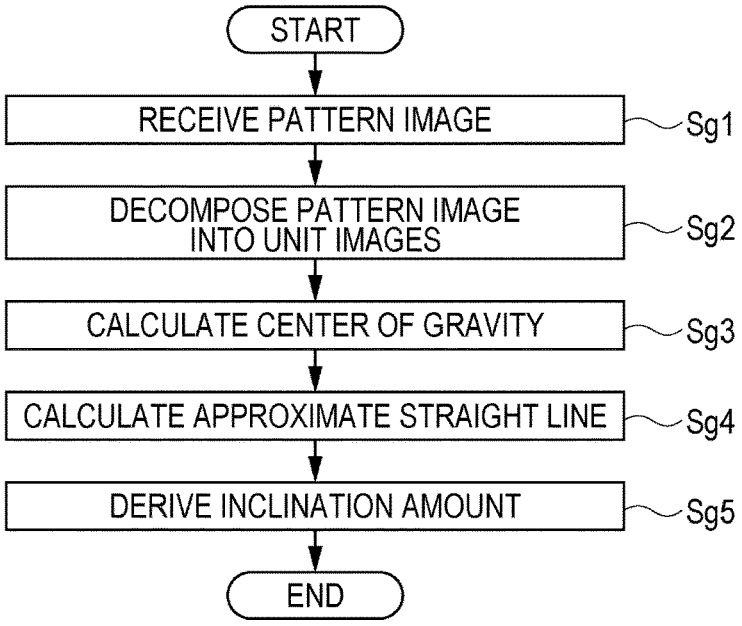
FIG. 13 is a flowchart illustrating a flow of a series of image processing for calculating the degree of inclination of the print head.

FIG. 13 is a flowchart illustrating a flow of a series of image processing in the control unit 30 for calculating the degree of inclination of the print head 13 (nozzle plate 132).

First, the control unit 30 receives the pattern image G1 (Step Sg1), separates and recognizes the pattern image G1 into the pattern image G1*a* and the pattern image G1*b*, then decomposes the pattern image G1 into pattern images (unit images) of the dots corresponding to respective nozzles 131 (Step Sg2). Here, the pattern image (unit image) of the dots corresponding to respective nozzles 131 is an image of individual line segment L.

Next, the control unit 30 obtains positions (coordinates) of the centers of gravity K of the unit images (images of the individual line segments L) (Step Sg3), and obtains an approximate straight line connecting the centers of gravity K from the positions (coordinates) of the obtained centers of gravity K (Step Sg4). The approximate straight line is obtained by, for example, a least square method, and an approximate straight line ($y=ax+b$) corresponding to a pattern image G1*a* and an approximate straight line ($y=cx+d$) corresponding to a pattern image G1*b* are derived.

Next, the inclination ($\theta y$ illustrated in FIG. 5) of the print head 13 (nozzle plate 132) is derived from the difference ($a-c$) in the inclination between the approximate straight lines (Step Sg5 (tendency calculation step)).

The relationship between the difference ($a-c$) in the inclination between the approximate straight lines and the inclination ($\theta y$) of the print head 13 (nozzle plate 132) is ($a-c$), which is the difference between the inclination of the approximate straight lines, $\propto \theta y$, and is determined by the specification of the printer 100.

Skew Adjustment

Next, skew adjustment for adjusting an inclination (rotation) in the XY plane of the print head 13 (nozzle plate 132) as illustrated in FIG. 9 will be described. The skew adjustment step is a skew adjustment step for adjusting the degree of an intersection angle between the scanning direction (X-axis direction) and the direction in which the nozzle row 130 extends.

For the pattern image used in the skew adjustment step, it is possible to use the same pattern image G1 (see FIG. 11) as in the parallelity adjustment step.

Figure 14:
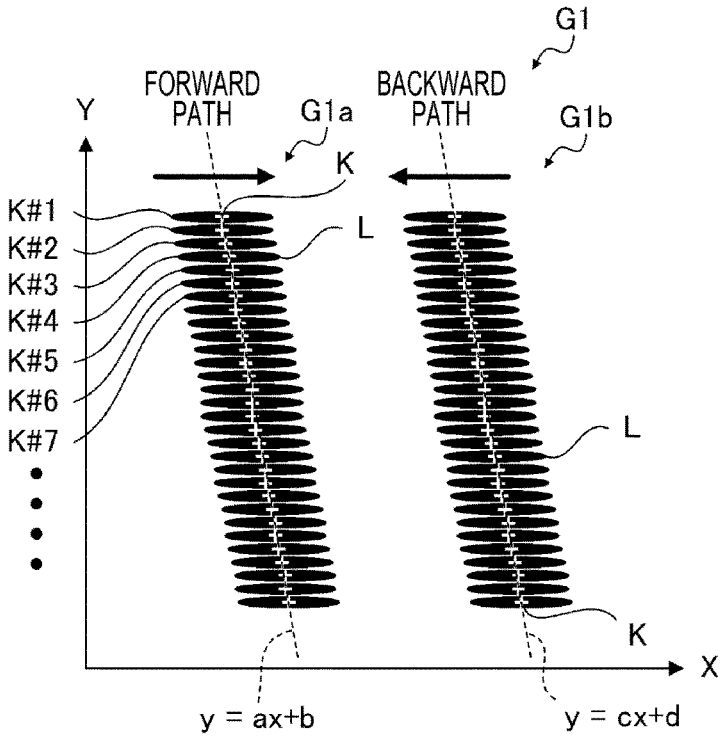
FIG. 14 is a conceptual diagram illustrating a pattern image printed when there is an inclination in the XY plane of the print head.

FIG. 14 is a conceptual diagram illustrating the pattern image G1 printed when there is an inclination (rotation) in the XY plane of the print head 13 (nozzle plate 132) as illustrated in FIG. 9.

As illustrated in FIG. 5, in a case where there is no inclination (bow in the Y-axis direction) of the print head 13 (nozzle plate 132) and there is no difference in ink ejection characteristics, the pattern image G1*a* and the pattern image G1*b* do not have different inclinations in the backward path with respect to the Y-axis direction. The approximate straight line (y=ax+b) corresponding to the pattern image G1*a* and the approximate straight line (y=cx+d) corresponding to the pattern image G1*b* are derived similarly to the flow described above (see FIG. 13), and when it is confirmed that the difference in the inclination between the approximate straight lines is small (a≈c), the inclination (a≈c) of the approximate straight line is obtained as an inclination amount to be adjusted.

Figure 15:
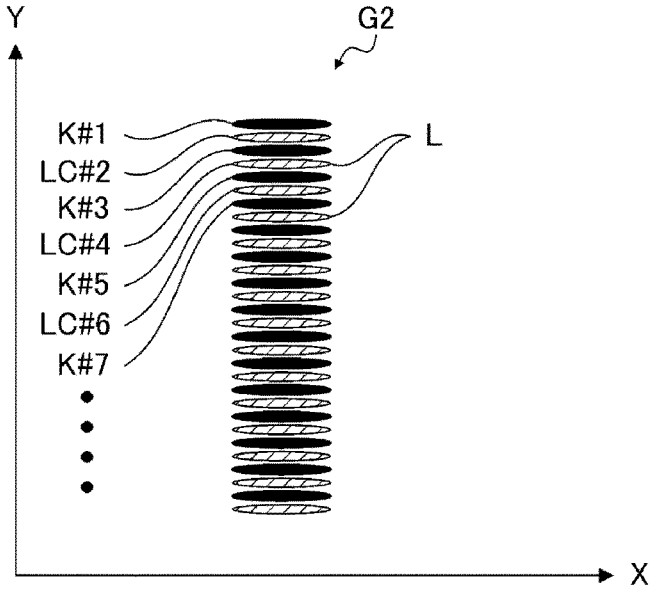
FIG. 15 is a conceptual diagram illustrating a pattern image used in a skew adjustment step.

As the pattern image used for the same skew adjustment, the pattern image G2 illustrated in FIG. 15 may be used.

The pattern image G2 is formed as the line segments L alternately aligned in the Y-axis direction by the nozzle rows 130 positioned at both ends of the print head 13 in the X-axis direction. Specifically, the nozzle row 130 (black ink nozzle row K) at one end uses the odd-numbered nozzles 131 and the nozzle row 130 (light cyan ink nozzle row LC) at the other end uses the even-numbered nozzle 131 to form a plurality of line segments L by continuously ejecting ink droplets a predetermined number of times at the same time, while performing scanning movement.

That is, the pattern image G2 for calculating the tendency of the spatial positional relationship between each nozzle 131 and the dot corresponding to each nozzle 131 is formed by the nozzles 131 constituting the nozzle row 130, which is positioned at both ends of the print head 13 in the X-axis direction, as the reference nozzle row 130 among the plurality of nozzle rows 130.

Figure 16:
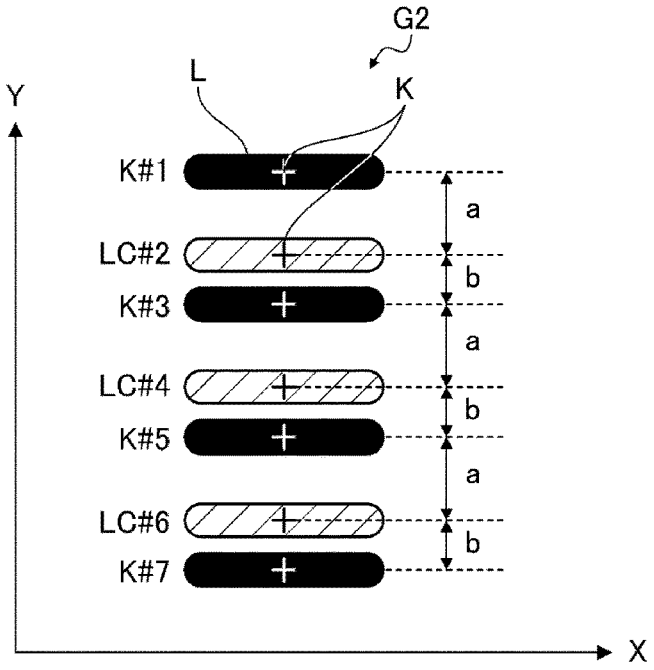
FIG. 16 is a conceptual diagram illustrating a portion of the pattern image printed when there is an inclination in the XY plane of the print head.

FIG. 16 is a conceptual diagram illustrating a portion of the pattern image G2 to be printed when there is an inclination (rotation) in the XY plane of the print head 13 (nozzle plate 132) as illustrated in FIG. 9.

The control unit 30 obtains the position (coordinates) of the center of gravity K of each unit image (image of the individual line segment L), and then calculates spacing (pitch a and pitch b) between the unit images (line segments L) by the light cyan ink nozzle row LC and the unit images (line segments L) by the black ink nozzle row K, which are adjacent to each other above and below the individual unit images (line segment L) by the light cyan ink nozzle row LC, and obtains an average of the calculated spacing.

As described with reference to FIG. 10, when there is an inclination (rotation) of the print head 13 as illustrated in FIG. 9, the black ink nozzle row K deviates in the +Y direction and relatively light cyan ink nozzle row LC deviates in the −Y direction and thus, spacing between the dot rows satisfies a relationship of pitch a>pitch b.

The degree (θp) of inclination (rotation) in the XY plane of the print head 13 (nozzle plate 132) can be quantified by calculating the difference (average a−average b).

The degree (θp) of inclination (rotation) of the print head 13 (nozzle plate 132) in the XY plane means the degree of intersection angle between the scanning direction (X-axis direction) and the direction in which the nozzle row 130 extends.

Parallelity Adjustment (Inclination Adjustment)

Next, inclination adjustment for adjusting the inclination of the print head 13 (nozzle plate 132) in the X-axis direction as illustrated in FIG. 7 will be described.

Figure 17:
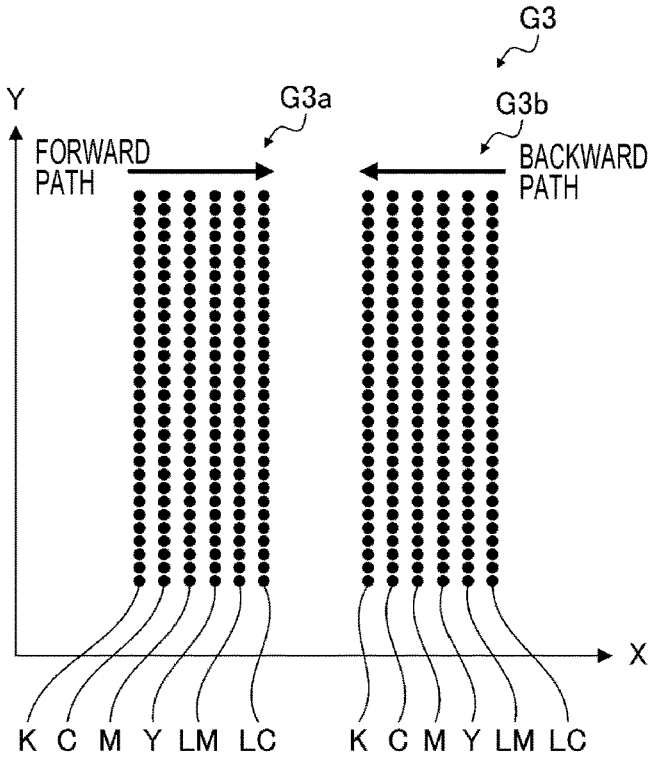
FIG. 17 is another conceptual diagram illustrating a pattern image used in an inclination adjustment step.

FIG. 17 is a conceptual diagram illustrating a pattern image G3 used in the inclination adjustment step.

The pattern image G3 is composed of a pattern image G3*a* and a pattern image G3*b* and is constituted with dot rows of six colors in which dots are aligned in the Y-axis direction and which are respectively formed by the nozzle rows 130 of six colors.

The pattern image G3*a* is constituted with six dot rows formed by ink droplets ejected at the same time for each nozzle row 130 at predetermined time intervals in order (that is, in order of black ink nozzle row K, cyan ink nozzle row C, magenta ink nozzle row M, yellow ink nozzle row Y, light magenta ink nozzle row LM, and light cyan ink nozzle row LC)) from the nozzle row 130 in the +X side of the print head 13 in the forward path in the scanning direction. That is, spacing between the dot rows of the respective colors is the same.

The pattern image G3*b* is constituted with six dot rows formed by ink droplets ejected at the same time for each nozzle row 130 at the predetermined time intervals in order from the nozzle row 130 in the −X side of the print head 13 (that is, in the reverse order to that of the forward path) in the backward path in the scanning direction. That is, the pattern image G3*b* is the same image as the pattern image G3*a*.

Figure 18:
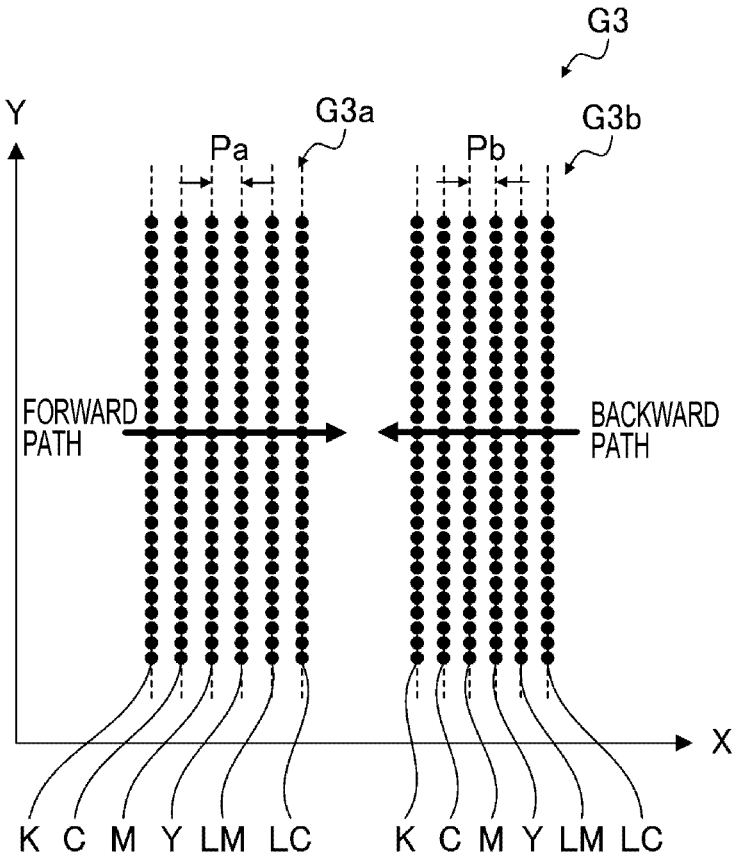
FIG. 18 is a conceptual diagram illustrating a pattern image printed in a case where there is an inclination of the print head in the X-axis direction.

FIG. 18 is a conceptual diagram illustrating the pattern image G3 to be printed in a case where there is an inclination of the print head 13 (nozzle plate 132) in the X-axis direction as illustrated in FIG. 7.

First, the control unit 30 receives the pattern image G3, separates and recognizes the pattern image G3 into the pattern image G3*a* and the pattern image G3*b*, then decomposes the pattern image G3 into pattern images (unit images) of the dot rows corresponding to respective nozzle rows 130.

Next, the control unit 30 obtains an approximate straight line (broken line illustrated in FIG. 18) of each dot row from the positions of the center of gravity of respective dots of each unit image (row of dots aligned for each color in the Y-axis direction).

Next, an average interval of the approximate straight lines in the images of the pattern images G3*a* and G3*b* (average of the pitch Pa in the pattern image G3*a* and average of the pitch Pb in the pattern image G3*b*) is calculated.

In a case where there is an inclination of the print head 13 (nozzle plate 132) in the X-axis direction as illustrated in FIG. 7, the longer a distance of the ink droplet ejected by the nozzle row 130 away from the platen 55 (surface of the roll paper 5), the more the landing timing is delayed and thus, the interval between the dot rows satisfies the relationship of pitch Pa>pitch Pb. The degree of inclination of the print head 13 (nozzle plate 132) in the X-axis direction can be quantified by calculating the difference (average Pa−average Pb).

Other Pattern Images

Figure 19:
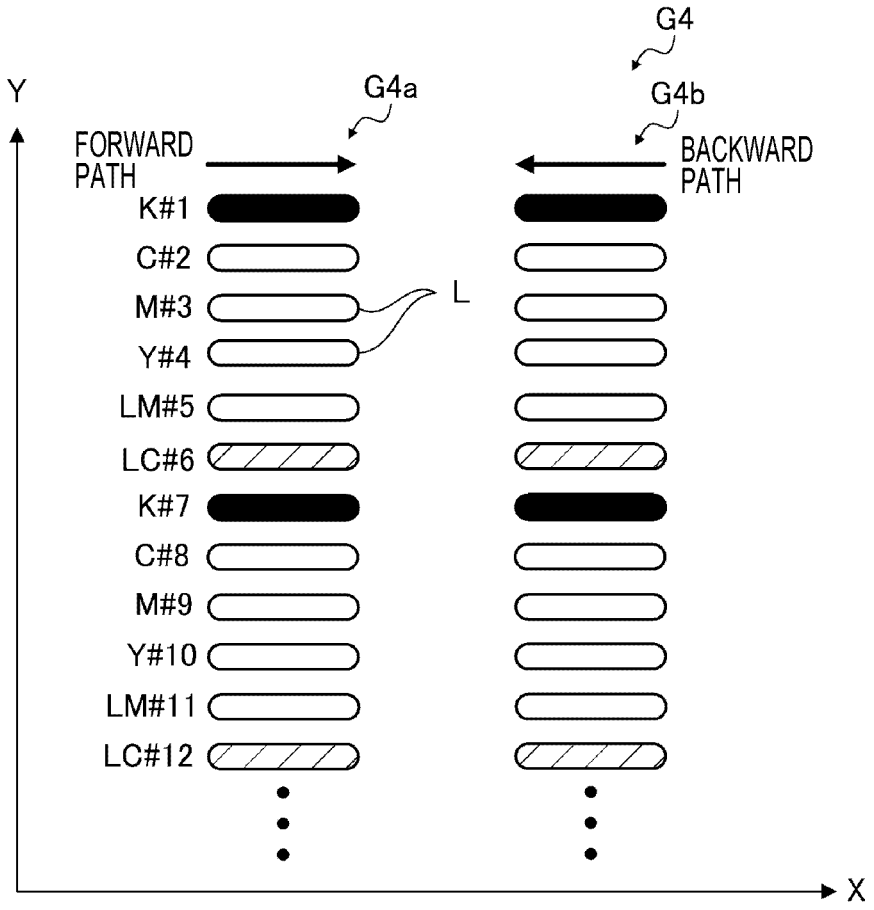
FIG. 19 is a conceptual diagram illustrating an example of a pattern image from which information capable of being used for adjustment of both parallelity adjustment (bow adjustment) and skew adjustment is obtained.

FIG. 19 is a conceptual diagram illustrating an example of a pattern image G4 from which information that can be used for adjustment of both parallelity adjustment (bow adjustment) and skew adjustment is obtained.

Information that can be used for adjustment is a quantitative value relating to the posture of the print head 13

(nozzle plate 132) described above, and is a quantitative value indicating the tendency of the spatial positional relationship between each nozzle 131 and the dot corresponding to each nozzle 131.

The pattern image G4 is composed of a pattern image G4*a* and a pattern image G4*b*.

The pattern image G4*a* is a pattern image formed in the forward direction in the scanning direction. As illustrated in FIG. 19, the pattern image G4*a* is an image rendered in such a way that the line segments L of six colors formed by six nozzle rows 130 are aligned to be located at the same position in the X-axis in order and to be located at nozzle pitches in the Y-axis direction in order (see FIG. 4). Specifically, when it is assumed that n=1 to 66, as the nozzles 131 used in each nozzle row 130, (6 n−5)-th nozzles are for the black ink nozzle row K, (6 n−4)-th nozzles are for the cyan ink nozzle row C, (6 n−3)-th nozzles are for the magenta ink nozzle row M, (6 n−2)-th nozzles are for the yellow ink nozzle row Y, (6 n−1)-th nozzles are for the light magenta ink nozzle row LM, and (6n)-th nozzles are for the light cyan ink nozzle row LC.

Similar to the pattern image G4*a*, the pattern image G4*b* is a pattern image to be formed in the backward path in the scanning direction.

Figure 20:
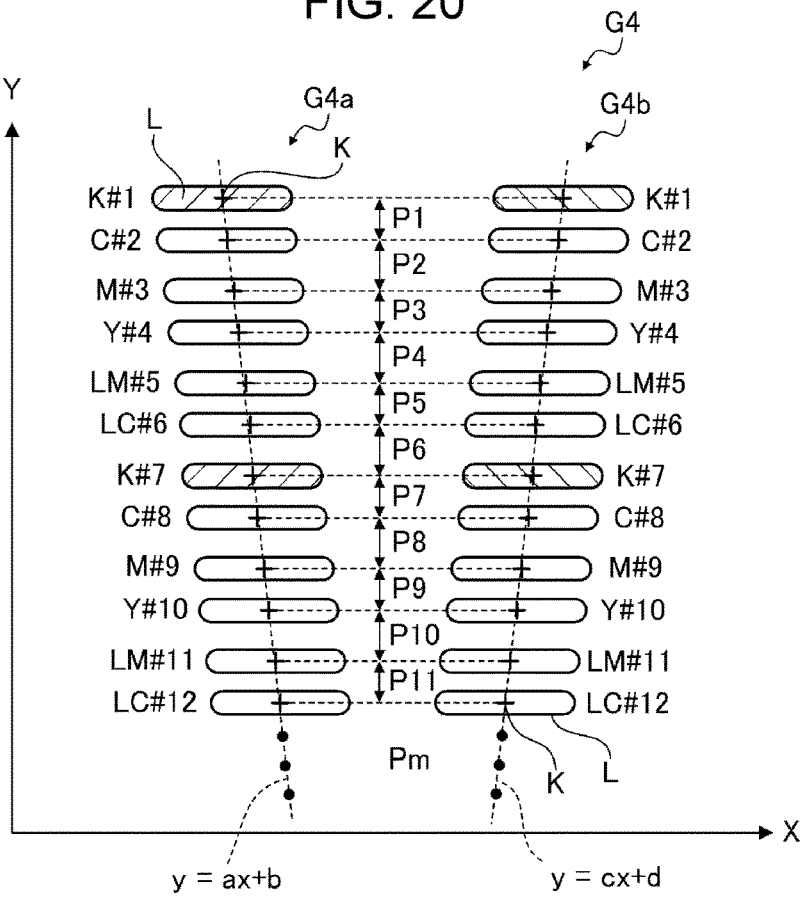
FIG. 20 is a conceptual diagram illustrating an example of a printed pattern image.

FIG. 20 is a conceptual diagram illustrating an example of the printed pattern image G4.

First, the control unit 30 receives the pattern image G4, separates and recognizes the pattern image G4 into the pattern image G4*a* and the pattern image G4*b*, then decomposes the pattern image G4 into unit images (images of individual line segments L).

Next, the control unit 30 obtains the positions (coordinates) of the centers of gravity K of the unit images (images of the individual line segments L) and obtains approximate straight lines (y=ax+b, y=cx+d) connecting the centers of gravity K in each of the pattern image G4*a* and the pattern image G4*b* in each pattern image G4 (pattern image G4*a* and pattern image G4*b*) from the obtained positions (coordinates) of the centers of gravity K.

Also, spacing (pitch Pm) the center of gravity K of each line segment L in the Y-axis direction is calculated.

As described above, the control unit 30 can derive the inclination (θy) of the print head 13 (nozzle plate 132) from the difference (a−c) of the inclination of the approximate straight line, and can derive the degree of inclination (rotation) in the XY plane of the print head 13 (nozzle plate 132) from analysis of the pitch Pm.

The control unit 30 analyzes the pattern image G4 so as to make it possible to obtain information for correcting the deviation of the ejection timing of each nozzle 131. Specifically, it is possible to correct deviation of the ejection timing of each nozzle 131 based on the amount of deviation (amount of deviation in the X-axis direction) of the center of gravity K of each line segment L with respect to the approximate straight lines (y=ax+b, y=cx+d).

The control unit 30 displays a quantitative value (θy, θx, θp, and the like (see FIGS. 5, 7, and 9) or predetermined adjustment values based on θy, θx, θp, and the like), which indicates the tendency (tendency of the spatial positional relationship between each nozzle 131 and the dot corresponding to each nozzle 131) derived as described above, on the touch panel 38 (see FIG. 2) and performs corresponding adjustment.

Adjustment Unit

Next, an adjustment unit that adjusts the attachment posture of the print head 13 (that is, adjustment of ink droplet landing position) will be described.

The printer 100 is provided with an adjustment unit 70 that adjusts the attachment posture of the print head 13 based on the calculated tendency (quantitative value for adjustment displayed on the touch panel 38).

The adjustment unit 70 includes an adjustment unit 70*y*, an adjustment unit 70*x*, an adjustment unit 70*p*, and the like.

Figure 21:
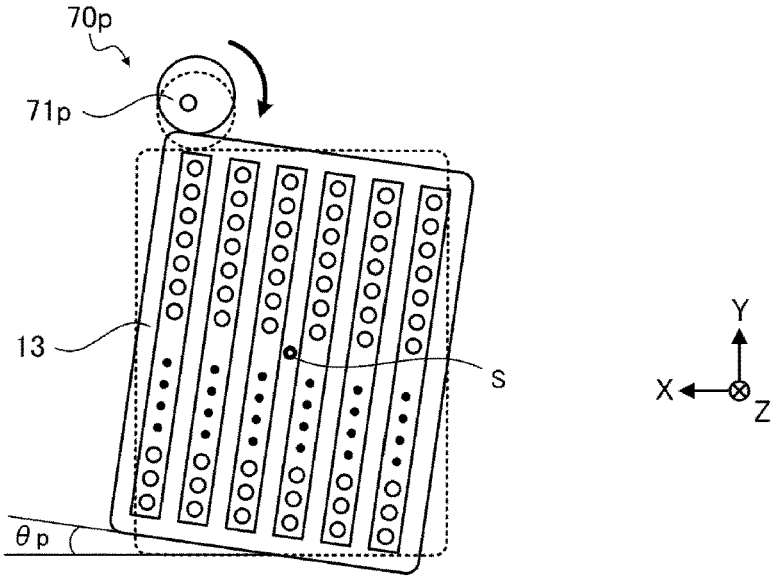
FIG. 21 is a schematic diagram illustrating a configuration of an adjustment unit.

FIG. 21 is a schematic diagram illustrating a configuration of the adjustment unit 70*p*.

The adjustment unit 70*p* includes an eccentric cam 71*p*.

The eccentric cam 71*p* is brought into contact with the side surface of the print head 13 and is rotated so as to make it possible to rotate the print head 13 in the XY plane (in the attachment surface to the carriage 41).

The print head 13 is supported so as to be rotatable within the attachment surface to the carriage 41 around the rotation center S by loosening fixing screws (not illustrated) to the carriage 41. Further, the print head 13 is configured so that the side surface thereof always contacts the circumferential portion of the eccentric cam 71*p*, and the rotation angle of the print head 13 varies based on the eccentricity of the eccentric cam 71*p*.

For the eccentric cam 71*p*, the correspondence between the rotation angle thereof and the rotation angle of the print head 13 is known, and it is possible to perform necessary adjustment by causing the eccentric cam 71*p* to rotate by an amount corresponding to the quantitative value indicating the above-described tendency derived by the control unit 30 can be performed.

Alternatively, for a rotation unit (for example, a rotary knob mechanism (not illustrated) capable of fine rotation adjustment of the eccentric cam 71*p* via a gear or the like) for rotating the eccentric cam 71*p*, a configuration in which click feeling is obtained every predetermined rotation amount may be adopted, and for the touch panel 38, a configuration in which the number of clicks or the like is displayed as a predetermined adjustment value corresponding to the needed rotation amount may be adopted.

Similar to the adjustment unit 70*p*, the adjustment unit 70*y* and the adjustment unit 70*x* are provided with an eccentric cam 71*y* and an eccentric cam 71*x*, respectively, and are configured to be able to adjust the posture of the print head 13 (inclination θy in the axial direction and inclination θx in the X-axis direction) based on eccentricity of each of the eccentric cam 71*y* and the eccentric cam 71*x*.

Regarding the landing position deviation of the ink droplet due to the inclination θx in the X-axis direction of the print head 13 (nozzle plate 132), a method (method including a timing adjustment step) of adjusting the ink droplet ejection timing for each nozzle row 130 may be adopted, instead of adjusting the inclination of the print head 13 (nozzle plate 132). That is, it is possible to perform adjustment (correction) of the landing position deviation by adjusting the ejection time of the ink droplet for the amount of change in the flight time of the ink droplet according to the distance of the nozzle row 130 to the platen 55 (surface of the roll paper 5).

Flow of Adjustment of Ink Droplet Landing Position

Figure 22:
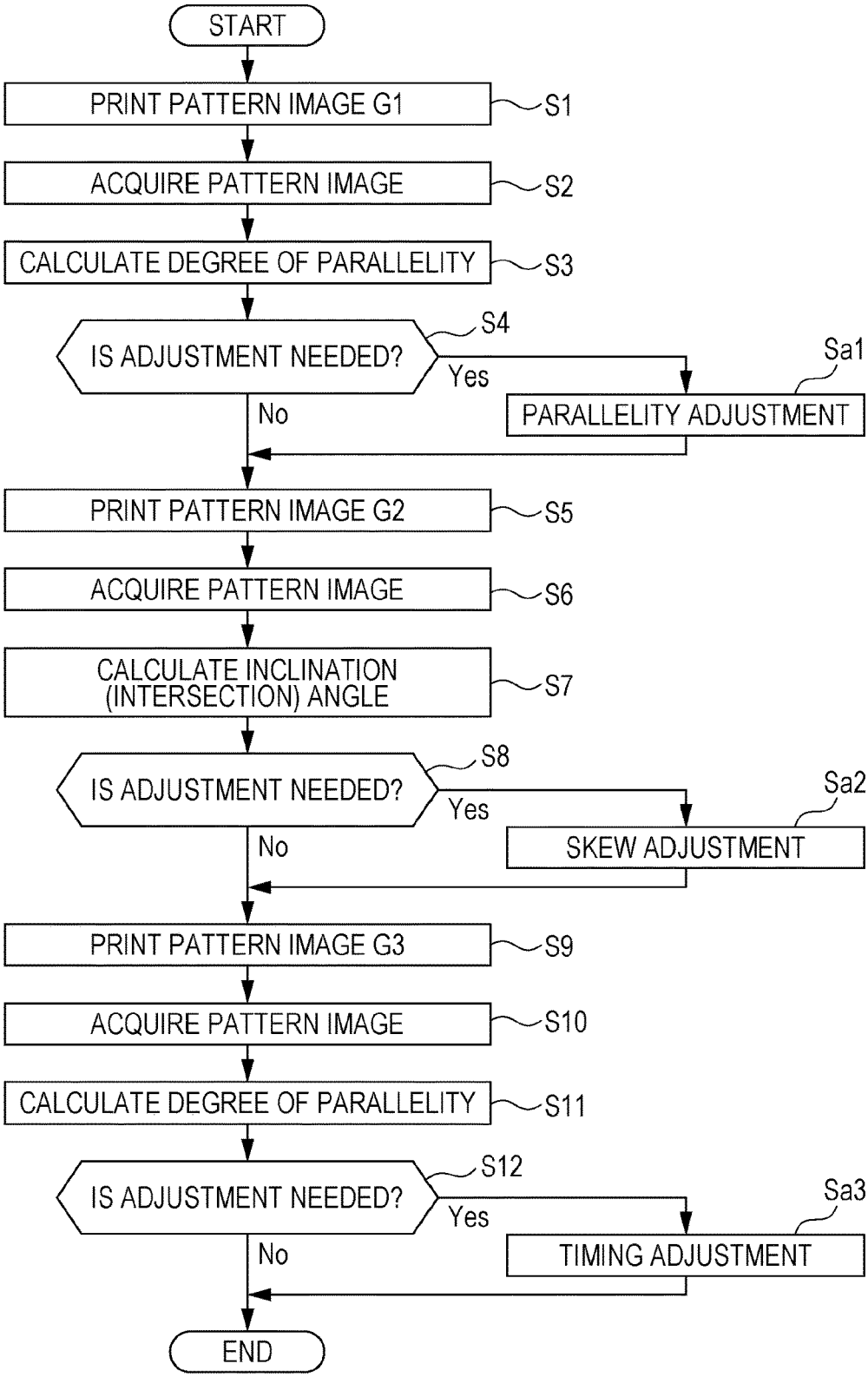
FIG. 22 is a flowchart illustrating an example of a series of flows for adjusting the ink droplet landing positions.

FIG. 22 is a flowchart illustrating an example of a series of flows (that is, a flow of an adjustment method of a recording head) for adjusting the ink droplet landing positions in the printer 100.

First, the pattern image G1 (see FIG. 11) is printed in order to perform parallelity adjustment (bow adjustment) (Step S1).

Next, the printed pattern image G1 is captured by the camera 60 and the pattern image G1 is acquired by the control unit 30 (Step S2 (image read step)).

Next, the control unit 30 calculates parallelity (inclination amount (θy)) of the print head 13 (nozzle plate 132) with respect to the Y-axis direction based on the acquired pattern image G1 (Step S3 (tendency calculation step) and displays parallelity (inclination amount (θy)) or a predetermined adjustment value based on the parallelity (θy) on the touch panel 38.

An operator who performs an adjustment operation references the displayed parallelity (inclination amount (θy)) or the predetermined adjustment value based on the displayed parallelity and determines whether adjustment is needed or not (Step S4). When it is determined that adjustment is needed, adjustment is performed based on a referenced value (that is, tendency calculated in the tendency calculation step) (Step Sa1).

Next, in order to perform the skew adjustment described above, the pattern image G2 (see FIG. 15) is printed (Step S5).

Next, the printed pattern image G2 is captured by the camera 60 and the pattern image G2 is acquired by the control unit 30 (Step S6 (image read step)).

Next, the control unit 30 calculates the degree of inclination (rotation) in the XY plane of the print head 13 (nozzle plate 132) (θp, that is, the degree of intersection angle between the scanning direction (X-axis direction) and the direction in which the nozzle row 130 extends) based on the acquired pattern image G2 (Step S7 (tendency calculation step)) and displays a skew amount (θp) or the predetermined adjustment value based on the skew amount on the touch panel 38.

The operator who performs the adjustment operation references the displayed skew amount (θp) or the predetermined adjustment value based on the displayed skew amount (θp) and determines whether adjustment is needed or not (Step S8). When it is determined that adjustment is needed, adjustment is performed based on a referenced value (that is, tendency calculated in the tendency calculation step) (Step Sa2).

Next, the pattern image G3 (see FIG. 17) is printed in order to perform the parallelity adjustment (inclination adjustment) described above (Step S9).

Next, the printed pattern image G3 is captured by the camera 60, and the pattern image G3 is acquired by the control unit 30 (Step S10 (image read step)).

Next, the control unit 30 calculates the degree of inclination (degree of parallelity (θx)) of the print head 13 (nozzle plate 132) with respect to the X-axis direction based on the acquired pattern image G3 (Step S11 (tendency calculation step) and displays skew amount (θp) or a predetermined adjustment value based on the skew amount on the touch panel 38.

The operator who performs an adjustment operation references the displayed parallelity (θy) or the predetermined adjustment value based on the displayed parallelity and determines whether adjustment is needed or not (Step S12). When it is determined that adjustment is needed, adjustment is performed based on a referenced value (that is, tendency calculated in the tendency calculation step) (Step Sa3).

As described above, the adjustment in step Sa3 may be adjusted by a timing adjustment step of adjusting the timing of ink droplet ejection for each nozzle row 130, in addition to the adjustment of the inclination (θx) of the print head 13 (nozzle plate 132) in the X-axis direction.

As described above, according to the adjusting method of the recording head adjusting method and the recording apparatus of Embodiment 1, the following effects can be obtained.

The adjustment method for adjusting the landing position of a droplet includes an image read step of reading a pattern image by dots formed by ejected droplets, and a tendency calculation step of calculating a tendency of a spatial positional relationship between each nozzle 131 and the dot corresponding to each nozzle 131 based on the pattern image read in the image read step. Since the landing position of the liquid droplet ejected from each nozzle is adjusted based on the tendency of the spatial positional relationship between each nozzle 131 and the dot corresponding to each nozzle 131, it is possible to more accurately perform adjustment not only regarding deviation in the attachment position of the print head 13 in a plane parallel to a printing surface of the roll paper 5 but also regarding deviation in the attachment position of the print head 13 in a direction intersecting with the printing surface of the roll paper 5. As a result, it is possible to more accurately suppress, for example, deterioration in printing quality due to an inclination of the print head 13 with respect to the printing surface of the roll paper 5.

According to this application example, the spatial positional relationship between each nozzle 131 and the dot corresponding to each nozzle 131 is calculated based on the inclination of the approximate straight line, which is obtained from the pattern image formed in the direction intersecting with the relative movement direction, with respect to the relative movement direction. Since the approximate straight line allows variation in the positions and sizes of dots formed on the roll paper 5 to contribute to calculation of the tendency as a statistically more reliable representative value, it is possible to more accurately obtain a tendency of the distance between each nozzle 131 and the recording surface (that is, a tendency of spatial positional relationship between each nozzle 131 and dots corresponding to each nozzle 131). As a result, it is possible to more accurately suppress, for example, deterioration in recording quality due to an inclination of the print head 13 with respect to the printing surface of the roll paper 5.

The center of gravity K of the pattern image of the dot corresponding to each nozzle 131 is detected and the approximate straight line is obtained based on a plurality of the centers of gravity K. For that reason, even when there is variation in each dot constituting the pattern image corresponding to each nozzle 131 varies, the tendency can be more accurately calculated. As a result, it is possible to more accurately suppress, for example, deterioration in recording quality due to an inclination of the print head 13 with respect to the printing surface of the roll paper 5.

In a case where the print head 13 is inclined with respect to the printing surface of the roll paper 5, the distance between the nozzle 131 and the printing surface becomes unequal in the plurality of nozzles 131 arranged in the print head 13 and thus, the difference is generated between the pattern image formed in the forward path relatively reciprocating with respect to the roll paper 5 in the relative movement direction and the pattern image formed in the backward path relatively reciprocating with respect to the roll paper 5. According to Embodiment 1, since the tendency is calculated based on the pattern image formed in the forward path relatively reciprocating in the scanning direction (relative movement direction) with respect to the roll paper 5 and the pattern image formed in the backward path relatively reciprocating in the scanning direction (relative movement direction) with respect to the roll paper 5, it is possible to more accurately obtain the tendency (that is, tendency of the spatial positional relationship between each nozzle 131 and the dot corresponding to each nozzle 131) of the distance between each nozzle 131 and the printing surface. As a result, it is possible to more accurately suppress, for example, deterioration in printing quality due to an inclination of the print head 13 with respect to the printing surface of the roll paper 5.

Since the parallelity adjustment step of adjusting the degree of parallelity between the nozzle row 130 and the roll paper 5 facing the nozzle row 130 based on the calculated tendency is included, in a case where the nozzle row 130 is not disposed parallel to the roll paper 5 facing the nozzle row 130, it is possible to more appropriate perform adjustment.

Since the skew adjustment step of adjusting the degree of the intersection angle of the nozzle row 130 with respect to the scanning direction (relative movement direction) based on the calculated tendency is included, in a case where the nozzle row 130 is disposed to deviate from a predetermined intersection angle with respect to the scanning direction (relative movement direction), it is possible to more accurately perform the adjustment.

In a case where the skew adjustment step is performed after the parallelity adjustment step, the parallelity adjustment step is performed first so as to make it possible to suppress the difference between the pattern image formed in the forward path in the scanning direction (relative movement direction) and the pattern image formed in the backward path. As a result, adjustment in the skew adjustment step for adjusting the degree of the intersection angle of the nozzle row 130 with respect to the scanning direction (relative movement direction) can be more easily performed.

The timing adjustment step of adjusting the timing of ejecting the liquid droplet from the nozzle 131 based on the tendency is included and thus, it is possible to correct deviation of the landing position of the liquid droplet in the scanning direction (relative movement direction) due to the inclination of the print head 13 in the scanning (relative movement direction) without correcting the inclination of the print head 13.

The printer 100 includes the camera 60 which reads the pattern image by dots formed by the ejected liquid droplets and the control unit 30 that calculates the tendency of the spatial positional relationship between each nozzle 131 and the dot corresponding to each nozzle 131 based on the pattern image read by the camera 60. That is, according to the printer 100 of Embodiment 1, it is possible to ascertain not only the tendency of deviation in an attachment position of the print head 13 in the plane parallel to the printing surface of the roll paper 5 but also the tendency of deviation in the attachment position of the print head 13 in a direction intersecting with the printing surface of the roll paper 5. As a result, for example, it is possible to perform adjustment for suppressing deterioration of the printing quality due to the inclination of the print head 13 with respect to the printing surface of the roll paper 5.

The printer 100 includes the adjustment unit 70 that adjusts the attachment posture of the print head 13 based on the calculated tendency. That is, in the printer 100, it is possible adjust the attachment posture of the print head 13 based on the tendency of the spatial positional relationship between each nozzle 131, which is calculated based on the pattern image read by the camera 60, and the dot corresponding to each nozzle 131. As a result, for example, in a case where the print head 13 is inclined with respect to the printing surface of the roll paper 5, it is possible to more accurately suppress deterioration in printing quality due to the inclination.

The plurality of nozzle rows 130 each of which is constituted with the plurality of the nozzles 131 aligned in the direction intersecting with the scanning direction (relative movement direction) are arranged and the pattern image for calculating the tendency is formed by the nozzles 131 constituting the reference nozzle row 130 among the plurality of nozzle rows 130. That is, the pattern image for calculating the tendency of the spatial positional relationship between the nozzle 131 and the dot corresponding to the nozzle 131 is formed by the nozzles 131 included in the reference nozzle row 130 among the plurality of nozzle rows 130 arranged in the print head 13. Specifically, it is possible to obtain a pattern image in which the attachment posture (degree of parallelity and degree of skewing) of the image is more reflected by forming a pattern image by using the nozzle rows arranged in both end areas of the print head 13 in the scanning direction (relative movement direction) and nozzle rows 130 including nozzles 131 arranged in corner area of the print head 13 as the reference nozzle rows 130. As a result, it is possible to more accurately obtain information of the posture of the print head 13 reflecting the tendency of the spatial positional relationship between each nozzle 131 and the dot corresponding to each nozzle 131.

Embodiment 2

Next, a printer 100L as a recording apparatus according to Embodiment 2 will be described. For the explanation, the same reference numerals are used for the same constituent elements as those in Embodiment 1 described above, and redundant explanations thereof are omitted.

Figure 23:
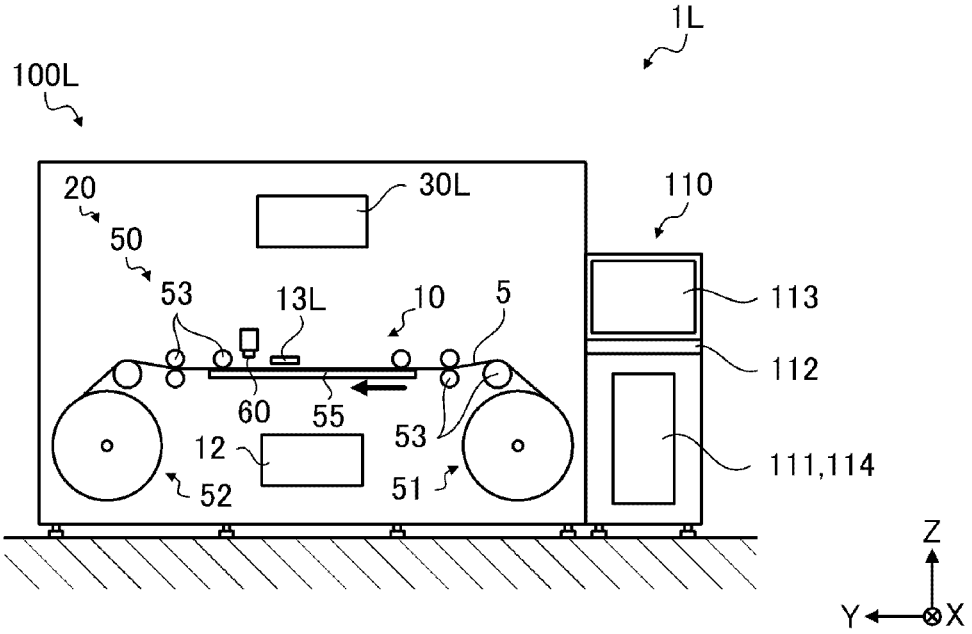
FIG. 23 is a front view illustrating a configuration of a recording apparatus (printer) according to Embodiment 2.

FIG. 23 is a front view illustrating a configuration of the printer 100L.

Although a so-called serial printer in which the print head 13 attached on the carriage 41 performs printing while moving in the scanning direction (X-axis direction in FIG. 1) has been described as the recording apparatus in Embodiment 1, the printer 100L as a recording apparatus of Embodiment 2 is a line printer.

The printer 100L constitutes a printing system 1L with the control device 110.

The printer 100L includes a line head 13L capable of ejecting ink droplets over the entire width direction of the roll paper 5 and a control unit 30L controlling the printer 100L including the line head 13L. The line head 13L is fixed at a position facing the platen 55, and printing is performed by ejecting ink droplets onto the roll paper 5 which moves in the transport direction. That is, in Embodiment 2, the transport direction (Y-axis direction) is the "relative movement direction" in the invention.

Figure 24:
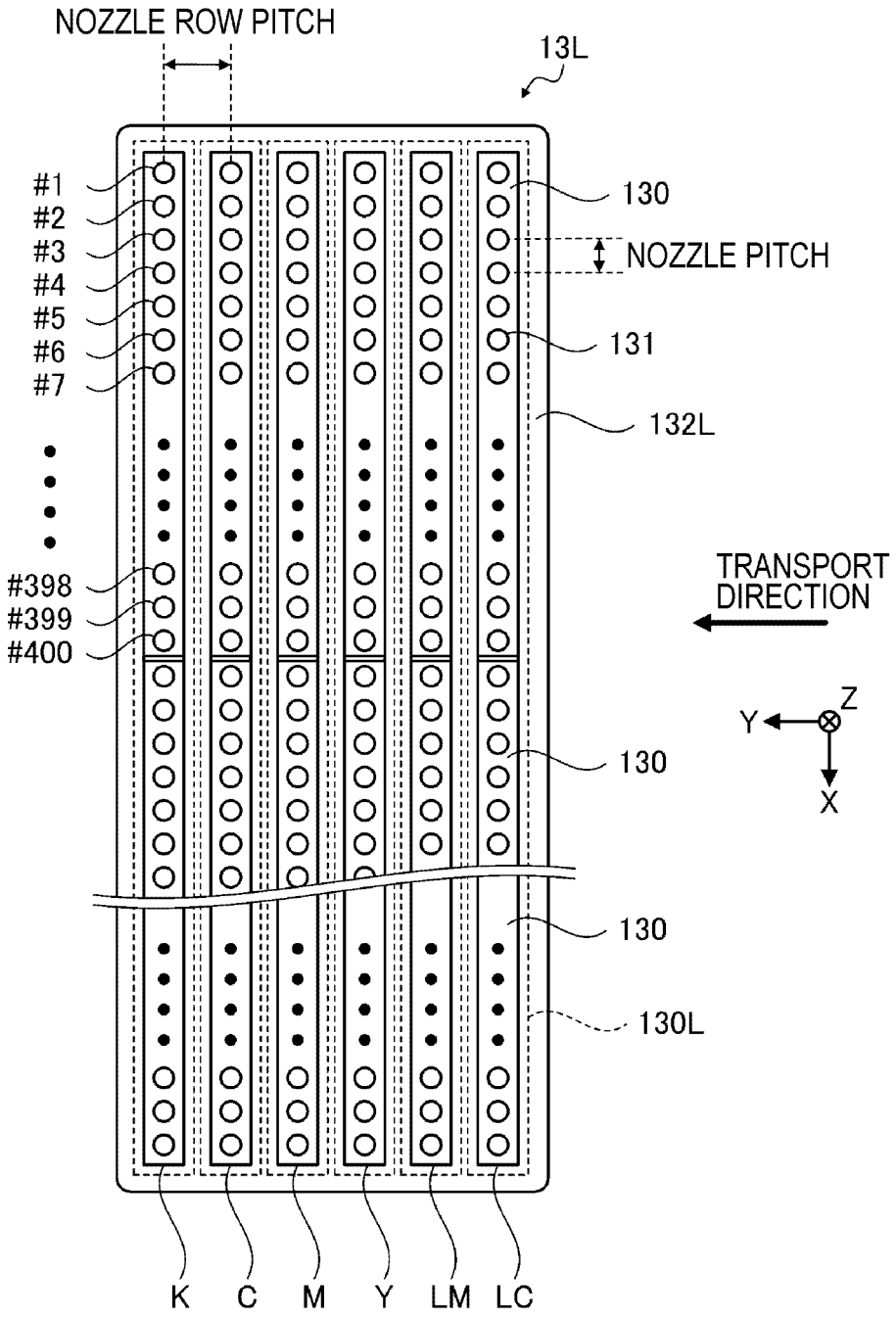
FIG. 24 is a schematic diagram illustrating an arrangement of nozzles in a line head provided in the recording apparatus (printer) according to Embodiment 2.

FIG. 24 is a schematic diagram illustrating an arrangement of nozzles in the line head 13L included in the printer 100L. FIG. 24 illustrates the state as seen from the lower surface (surface on the nozzle plate 132L side where the nozzle 131 is formed) of the line head 13L, similar to FIG. 4.

As illustrated in FIG. 24, the line head 13L includes six nozzle rows 130L configured by aligning a plurality of nozzle rows 130 that eject the same ink are in series in the width direction (X-axis direction) of the roll paper 5.

Even in such a configuration, there are cases in which the ink droplet landing position deviates from a predetermined position due to variation in the attachment posture of the line head 13L and printing quality is lowered in some cases. For this, similarly to the printer 100, the printer 100L includes the camera 60 as an "image reading unit" that reads a pattern image by dots formed by ejected ink droplets and has a function of calculating the tendency of the spatial positional relationship between each nozzle 131 and the dot corresponding to each nozzle 131 based on the pattern image read by the camera 60, as a function of the control unit 30L. It is possible to adjust the attachment posture of the print head 13 based on the tendency (tendency of the spatial positional relationship between each nozzle 131 and the dot corresponding to each nozzle 131) calculated based on the printed pattern image.

Figure 25:
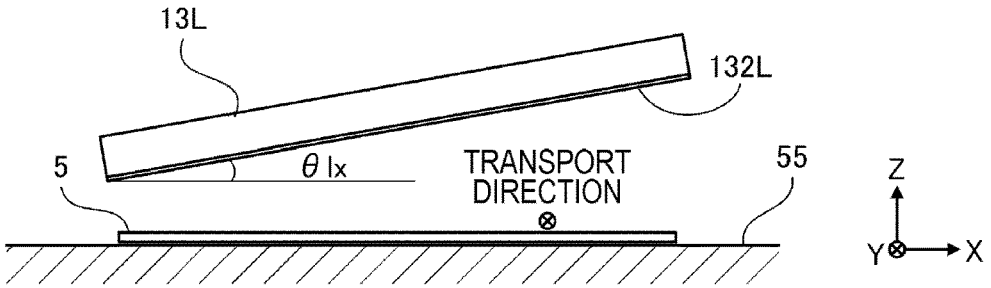
FIG. 25 is a conceptual diagram for explaining variation in an attachment posture of the line head.

FIG. 25 illustrates an example in a case where the line head 13L (nozzle plate 132L) is attached in a posture inclined with respect to the platen 55 (surface of the roll paper 5). As the line head 13L moves in the −X direction, the line head 13L (nozzle plate 132L) is inclined at an angle θlx so as to approach the platen 55 (surface of the roll paper 5).

This example corresponds to a case where the inclination of line head 13L can be adjusted by the parallelity adjustment (bow adjustment) described with reference to FIG. 5 in Embodiment 1. But, it is needed to reciprocate the roll paper 5 in the Y-axis direction.

Figure 26:
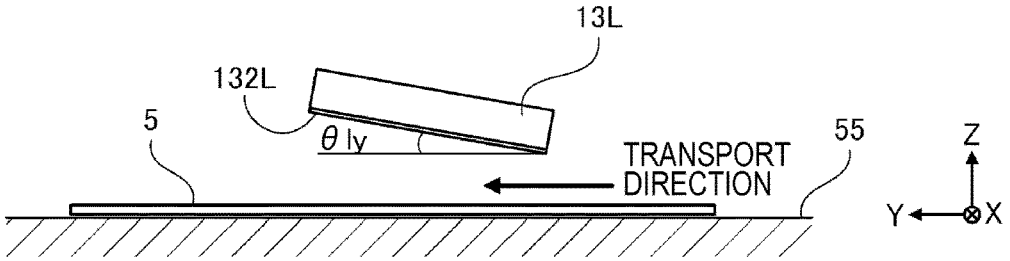
FIG. 26 is another conceptual diagram for explaining variation in the attachment posture of the line head.

FIG. 26 illustrates another example in which the line head 13L (nozzle plate 132L) is inclined with respect to the platen 55 (surface of the roll paper 5). As the line head moves in the −Y direction, the line head 13L (nozzle plate 132L) is inclined at an angle θly so as to approach the platen 55 (surface of the roll paper 5). That is, the line head 13L is attached in such a way that the distance between the nozzle row 130L of each color aligned in parallel and the platen 55 (surface of the roll paper 5) becomes shorter as the nozzle row 130L positioned on the −Y side becomes shorter.

This example corresponds to a case where the inclination of line head 13L can be adjusted by the parallelity adjustment (inclination adjustment) described with reference to FIG. 7 in Embodiment 1.

Figure 27:
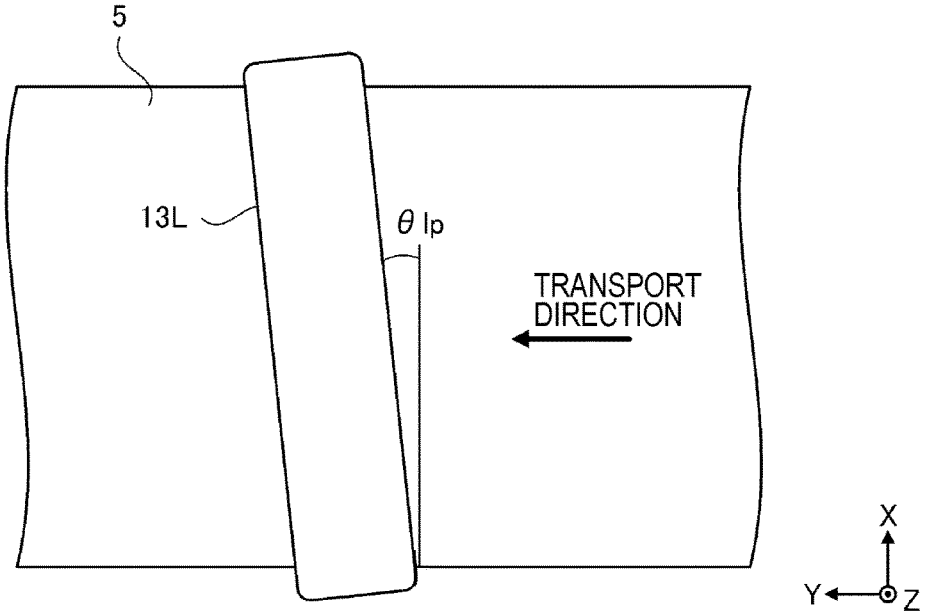
FIG. 27 is another conceptual diagram for explaining variation in the attachment posture of the line head.

FIG. 27 illustrates an example in a case where the line head 13L (nozzle plate 132L) is rotated and attached within a plane (XY plane) parallel to the platen 55 (surface of the roll paper 5). As seen from top of the line head 13L, the line head 13L is attached by being rotated at an angle θlp counterclockwise.

This example corresponds to a case where the inclination of line head 13L can be adjusted by the skew adjustment described with reference to FIG. 9 in Embodiment 1.

As described above, the printer 100L (that is, line printer) as a recording apparatus according to Embodiment 2 also includes the camera 60 as an "image reading unit" that reads a pattern image by dots formed by ejected ink droplets and has a function of calculating the tendency of the spatial positional relationship between each nozzle 131 and the dot corresponding to each nozzle 131 based on the pattern image read by the camera 60, as a function of the control unit 30L. As a result, it is possible to obtain an appropriate quantitative value for adjusting the ink droplet landing position. The adjustment unit 70 for adjusting the attachment posture of the print head 13 is provided so as to make it possible to obtain the same effect as in Embodiment 1 and to adjust the inclination of line head 13L based on the tendency (tendency of the spatial positional relationship between each nozzle 131 and the dot corresponding to each nozzle 131) calculated based on the printed pattern image.

The invention is not limited to the embodiment described above, and various modifications and improvements can be added to the embodiment described above.

Modification Example 1

In Embodiment 1, matters that the adjustment unit 70*y*, the adjustment unit 70*x*, and the adjustment unit 70*p* that adjust the attachment posture of the print head 13 are provided and the eccentric cam 71*y*, the eccentric cam 71*x*, and the eccentric cam 71*p* are rotated by an operator who performs the adjustment operation based on the quantitative value for adjustment derived by the control unit 30 are described, but the configuration of Embodiment 1 is not limited to such a configuration.

For example, a configuration in which a motor for rotating the eccentric cam 71*y*, the eccentric cam 71*x*, and the eccentric cam 71*p* may be provided for each of the adjustment unit 70*y*, the adjustment unit 70*x*, and the adjustment unit 70*p* and each motor is driven based on the quantitative value for adjustment derived by the control unit 30 may be adopted.

With such a configuration, it is possible to automate adjustment of the attachment posture of the print head 13.

Modification Example 2

In Embodiment 1, matters that the control unit 30 calculates the tendency of the spatial positional relationship between each nozzle 131 and the dot corresponding to each nozzle 131 based on the pattern image received from the camera 60 are described, but a configuration in which calculation of the tendency of the spatial positional relationship is performed by the control device 110 (personal computer) connected to the printer 100 may be adopted. A configuration in which a quantitative value (θy, θx, θp, and the like (see FIGS. 5, 7, and 9, or a predetermined adjustment value based on θy, θx, θp, and the like) indicating the calculated tendency (tendency of the spatial positional relationship between each nozzle 131 and the dot corresponding to each nozzle 131) is displayed on the display unit 113 included in the control device 110 may be adopted.

Modification Example 3

In Embodiment 1, matters that the pattern image G1 used in the parallelity adjustment step is formed by ink droplets ejected from all the nozzles 131 of the black ink nozzle row K having a high contrast with respect to, for example, the white roll paper 5 are described, the invention is not limited to the method of forming (printing) the pattern image G1 with one nozzle row 130 described as such.

For example, the pattern image G1 may be formed (printed) by five nozzle rows 130 (cyan ink nozzle row C, magenta ink nozzle row M, yellow ink nozzle row Y, light magenta ink nozzle row LM, and light cyan ink nozzle row LC) excluding the black ink nozzle row K. In this case, the ejection timing is controlled so that each ink droplet ejected from each nozzle 131 (see FIG. 4) at the same position in the Y-axis direction lands at the same position. That is, the pattern image G1 is formed by ink droplets of a plurality of colors.

Since a pattern image is formed by ink droplets of the plurality of colors, that is, a pattern image is formed by the plurality of nozzles 131 included in a plurality of nozzle rows 130, the tendency (tendency of the spatial positional relationship between each nozzle 131 and the dot corresponding to each nozzle 131) can be obtained as the tendency (for example, as a tendency over the entire print head) of the plurality of nozzles 131 included in the plurality of nozzle rows 130. Since the pattern is formed by landing ink of different colors on the same position of the pattern image from the plurality of nozzle rows 130, the pattern image G1 becomes a pattern of lower brightness as in the composite black color, for example. Accordingly, for example, when the pattern image G1 is formed on a white printing medium, contrast of the color becomes high and the tendency becomes more easily recognized.

This application claims priority under 35 U.S.C. § 119 to Japanese Patent Application No. 2017-105376, filed May 29, 2017. The entire disclosure of Japanese Patent Application No. 2017-105376 is hereby incorporated herein by reference.

What is claimed is:

1. In a recording apparatus that includes a recording head in which a plurality of nozzles are arranged and that performs recording by ejecting liquid droplets while relatively moving in a relative movement direction with respect to a recording medium, a method for adjusting a landing position of a liquid droplet in the recording apparatus, the method comprising:

reading a pattern image by dots formed by the ejected liquid droplets;

calculating a tendency of a spatial positional relationship between each of the nozzles and a dot corresponding to each of the nozzles based on the read pattern image by:

generating an approximate straight line from the pattern image; and determining the tendency based on an inclination of the approximate straight line determined from the pattern image, wherein the landing position of the liquid droplet ejected from each of the nozzles is adjusted based on the tendency calculated in the calculating the tendency of the spatial positional relationship.

2. The adjustment method of the recording head according to claim 1, wherein the approximate straight line is obtained from the pattern image formed in a direction intersecting with the relative movement direction, with respect to the relative movement direction.

3. The adjustment method of the recording head according to claim 2, wherein a center of gravity of the pattern image of the dot corresponding to each nozzle is detected and the approximate straight line is obtained based on a plurality of the centers of gravity.

4. The adjustment method of the recording head according to claim 1, wherein the tendency is calculated based on the pattern image formed in a forward path relatively reciprocating in the relative movement direction with respect to the recording medium and the pattern image formed in a backward path relatively reciprocating in the relative movement direction with respect to the recording medium.

5. The adjustment method of the recording head according to claim 1, further comprising:

a parallelity adjustment step of adjusting the degree of parallelity between a nozzle row constituted with the plurality of nozzles aligned in a direction intersecting with the relative movement direction and the recording medium facing the nozzle row based on the tendency.

6. The adjustment method of the recording head according to claim 5, further comprising:

a skew adjustment step of adjusting the degree of intersection angle between the relative movement direction and the direction in which the nozzle row extends based on the tendency.

7. The adjustment method of the recording head according to claim 6, wherein the skew adjustment step is performed after the parallelity adjustment step.

8. The adjustment method of the recording head according to claim 1, further comprising:

a timing adjustment step of adjusting a timing of ejecting the liquid droplet from the nozzle based on the tendency.

9. A recording apparatus comprising:

a recording head which includes a plurality of nozzles for ejecting liquid droplets onto a recording medium are arranged;

a moving unit which relatively moves the recording head in a relative movement direction with respect to the recording medium;

an image reading unit which reads a pattern image by dots formed by the ejected liquid droplets; and a control unit which calculates a tendency of a spatial positional relationship between each nozzle and a dot corresponding to each nozzle based on the pattern image read by the image reading unit, wherein the control unit is configured to calculate the tendency by determining an approximate straight line from the pattern image and determining the tendency based on an inclination of an approximate straight line determined from the pattern image.

10. The recording apparatus according to claim 9, further comprising:

an adjustment unit which adjusts an attachment posture of the recording head based on the calculated tendency.

11. The recording apparatus according to claim 9, wherein a plurality of nozzle rows each of which is constituted with a plurality of the nozzles aligned in a direction intersecting with the relative movement direction are arranged, and the pattern image for calculating the tendency is formed by the nozzles constituting a reference nozzle row among the plurality of nozzle rows.

12. The recording apparatus according to claim 9, wherein the nozzle rows constituted with the plurality of nozzles aligned in the direction intersecting with the relative movement direction are arranged for each color of the liquid droplets to be ejected, and the pattern image is formed by the liquid droplets having a plurality of colors.

* * * * *